US005268880A

United States Patent [19]

Meister et al.

[11] Patent Number: 5,268,880

[45] Date of Patent: Dec. 7, 1993

[54] CONTROL ARRANGEMENT FOR A TIMEPIECE ADAPTED TO RECEIVE RADIO BROADCAST MESSAGES

[75] Inventors: Pierre-André Meister, Bienne; Viron Teodoridis, Hauterive, both of Switzerland

[73] Assignee: Eta SA Fabriques d'Ebauches, Grenchen, Switzerland

[21] Appl. No.: 57,826

[22] Filed: May 7, 1993

[30] Foreign Application Priority Data

May 14, 1992 [CH] Switzerland ..... 545/92

[51] Int. Cl.[5] ..... G04B 47/00; G08B 5/22

[52] U.S. Cl. ..... 368/10; 340/825.44; 455/344

[58] Field of Search ..... 368/10, 46, 47; 340/825.44–825.47; 455/344

[56] References Cited

U.S. PATENT DOCUMENTS

| | | | |
|---|---|---|---|
| 4,398,831 | 8/1983 | Fatton et al. | 368/76 |
| 4,620,797 | 11/1986 | Besson et al. | 368/21 |
| 4,884,252 | 11/1989 | Teodoridis et al. | 368/10 |
| 5,172,348 | 12/1992 | Paratte | 368/47 |

FOREIGN PATENT DOCUMENTS

| | | |
|---|---|---|
| 0175961 | 4/1986 | European Pat. Off. . |
| 0339482 | 11/1989 | European Pat. Off. . |
| 0460526 | 12/1991 | European Pat. Off. . |
| 643427 | 6/1984 | Switzerland . |
| 9111875 | 8/1991 | World Int. Prop. O. . |

*Primary Examiner*—Vit W. Miska

*Attorney, Agent, or Firm*—Griffin Butler Whisenhunt & Kurtossy

[57] ABSTRACT

The timepiece includes a timekeeper displaying hours (4) and minutes (5), a receiver for radio broadcast messages capable of being read on a display (7) and a control arrangement (3) including a stem fitted into a crown (10). The stem-crown can be brought into three different axial positions, a first stable drawn-out position in which the timekeeper may be set to the time of day by rotation of the crown, a second stable neutral position in which received messages may be displayed one after the other by rotation of the crown and a third pushed-in unstable position in which the displayed message can be erased or protected.

17 Claims, 19 Drawing Sheets

CONTROL ARRANGEMENT FOR A TIMEPIECE ADAPTED TO RECEIVE RADIO BROADCAST MESSAGES

The present invention concerns a timepiece for displaying at least hours and minutes, a receiver for radio broadcast messages made up from characters, a memory for storing said messages, a cell for displaying at least said messages, an acoustic or mechanical transducer and a control arrangement including at least one stem fitted into a crown adapted to be manually actuated.

BACKGROUND OF THE INVENTION

A timepiece answering to the generic definition hereinabove has already been described in several documents published in the name of the same applicant. The general arrangement of the antenna confined within the watch case forms the subject of patent document EP-B-0 339 482 (U.S. Pat. No. 4,884,252). The assembly of the movement, the caseband and the back cover of such a timepiece is described in patent document EP-A-0 460 526. Finally, the arrangement of the power cell energizing the radio frequency portion of the watch is set forth in patent document EP-A-0 460 525.

As appears from what has just been said hereinabove, the timepiece in question is doubled by an apparatus for seeking persons which will be hereinafter designated by the appellation "pager". As will be seen further on, the pager portion is made up of an antenna, a receiver circuit, a decoder, a microprocessor and a memory capable of recording several messages, each of such messages being adapted to appear upon request on an LCD display cell. The pager is completed by an acoustic diffuser signalling for instance the arrival of a message. Here the pager appears essentially as a micro-receptor signalling the user that he is sought after by a third person.

There exist pagers which transmit only one or several acoustic signals. When the signal sounds, the user must then compose an agreed-upon number on a telephone apparatus. The pager in question in the present description enables the user to know, at the same time as an acoustic signal may sound, which third person is seeking him and this through the appearance of a message on a display cell, such message consisting in most cases of a telephone number to call back. In order to send his message, the third person commences by composing on his telephone apparatus the number of the pager to be attained, after which a special acoustic signal sounds in the receiver. He next composes his message by means of a digital keyboard available to him on his own apparatus and waits for the telephone exchange to advise him that his call has been recorded. As soon as this confirmation has been received, the receiver can be hung up again. A short period later, the message sent will appear on the pager which has been called, accompanied by a warning signal should the user so desire.

To combine a pager with a wristwatch is advantageous because the apparatus is permanently worn by the user who, because of this, will not forget to take it with him and also because it is of a dimension greatly reduced from that exhibited by independent pagers already known in the state of the art. Such combination, however, poses technical problems which are difficult to resolve. Certain of such problems have already formed the object of descriptions in the documents cited hereinabove. The present invention aims to resolve a problem which has not been dealt with until now and which is that posed by the control arrangement of an apparatus combining at the same time a wristwatch and a pager, in which it concerns, on the one hand, the ability to correct the time displayed by the watch and on the other hand the ability if necessary to cause the message to shift and the ability to protect or erase messages received by the pager. Such functions are assured, according to the present invention, by a single stem-crown.

SUMMARY OF THE INVENTION

The invention is characterized by the fact that the stem may be brought into at least three different axial positions, a first stable position in which the timekeeper may be set to the time of day by rotation of the crown, a second stable position in which the received messages can be at least displayed one after the other by rotation of the crown, and a third unstable position in which the message displayed can be at least erased or protected by action exerted in the longitudinal direction of the stem.

The invention will now be explained by means of the examples illustrated by the drawings.

DESCRIPTION OF THE PREFERRED EMBODIMENTS

Figure 8:
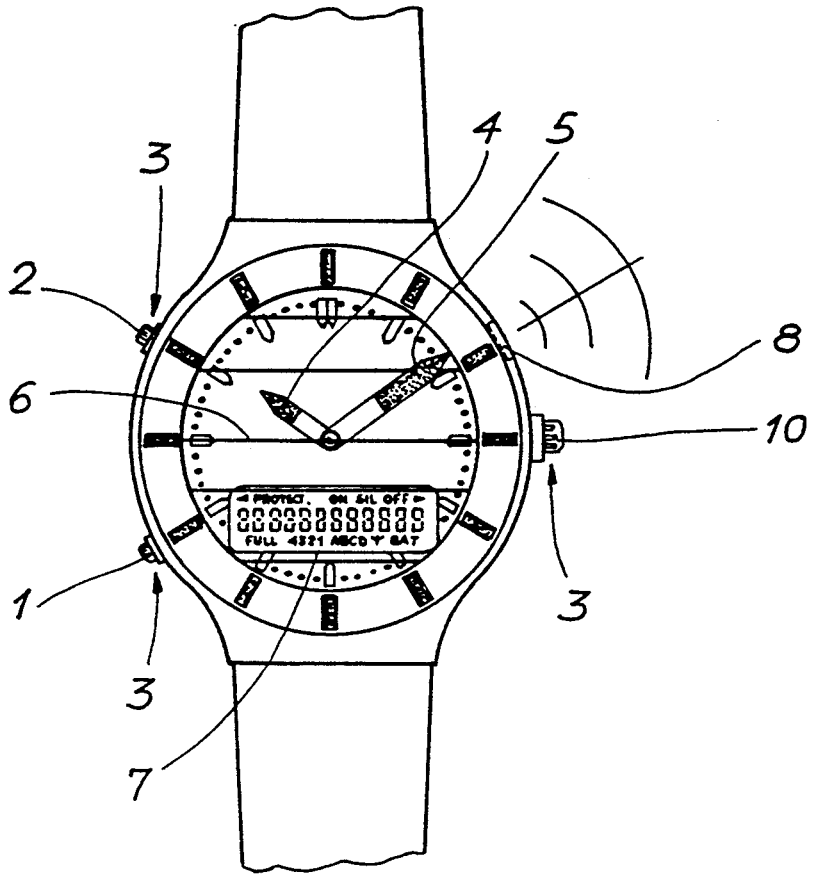
FIG. 8 is a plan view of a first embodiment of the pager watch according to the invention.
Figure 15:
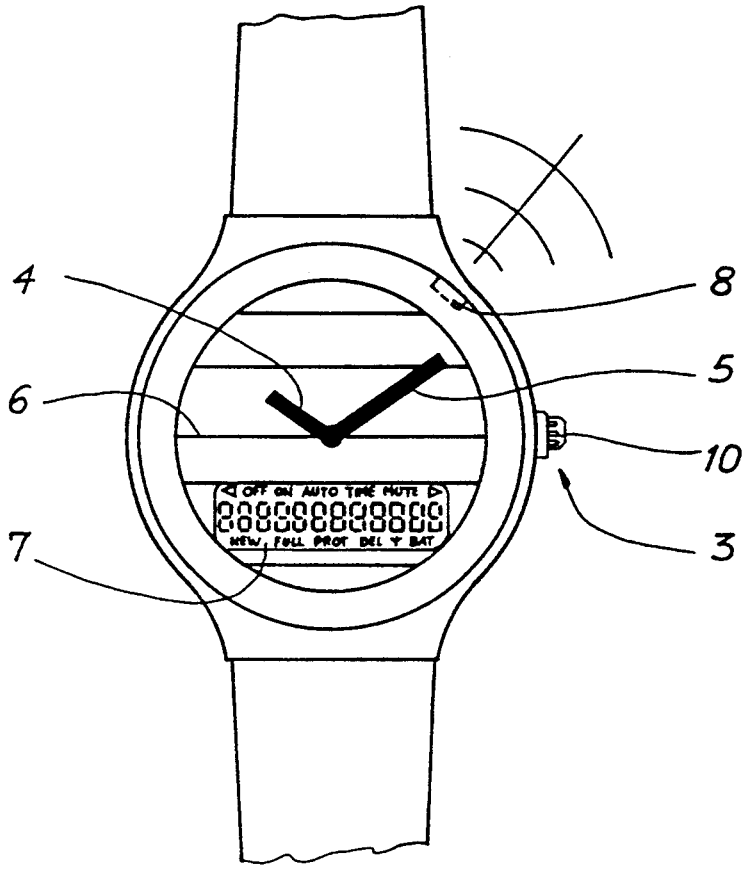
FIG. 15 is a plan view of a second embodiment of the pager watch according to the invention.

FIGS. 8 and 15 are plan views of the first and second embodiments of the pager watch according to the invention. This timepiece includes a timekeeper which displays the time of day at least by means of an hours hand 4 and minutes hand 5. The timepiece further includes a pager system, that is to say, an arrangement comprising a receiver for radio - broadcast messages made up from characters and a memory for storing such messages, such receiver and memory forming the objective of a description which will be found hereinafter. The messages are captured by an antenna wound around the caseband of the watchcase and which appears on FIGS. 8 and 15 in the form of wires 6. A description of this antenna may be read in patent document EP-B-0 339 482 (U.S. Pat No. 4,884,252). The messages appear on a cell 7 formed for example from a liquid crystal. The two embodiments of the pager watch further include a control arrangement 3 comprising in both cases at least a stem fitted into a crown 10 adapted to be manually actuated, the description of which is about to follow. An acoustic diffuser 8, only the orifice of which has been shown on FIGS. 8 and 15, enables signalling, among others, of the arrival of a message. The constructional organization of the entire arrangement is described in patent document EP-A-0 460 526 to which one may refer in order to obtain further details.

In both embodiments and in accordance with the invention, the stem may be brought into at least three different axial positions in accordance with a mechanism which will now be described in having reference to FIGS. 1 to 7. The first position is a stable position, shown on FIG. 1, in which position the timepiece may be set to the time of day by rotation of the crown. The second position, also a stable position, is shown on FIG. 2. In this position received messages may at least be displayed one after the other by rotation of the crown. Finally, the third position, shown on FIG. 3, is unstable and enables erasing or protecting the message by exerting an action in the longitudinal sense of the stem.

Figure 1:
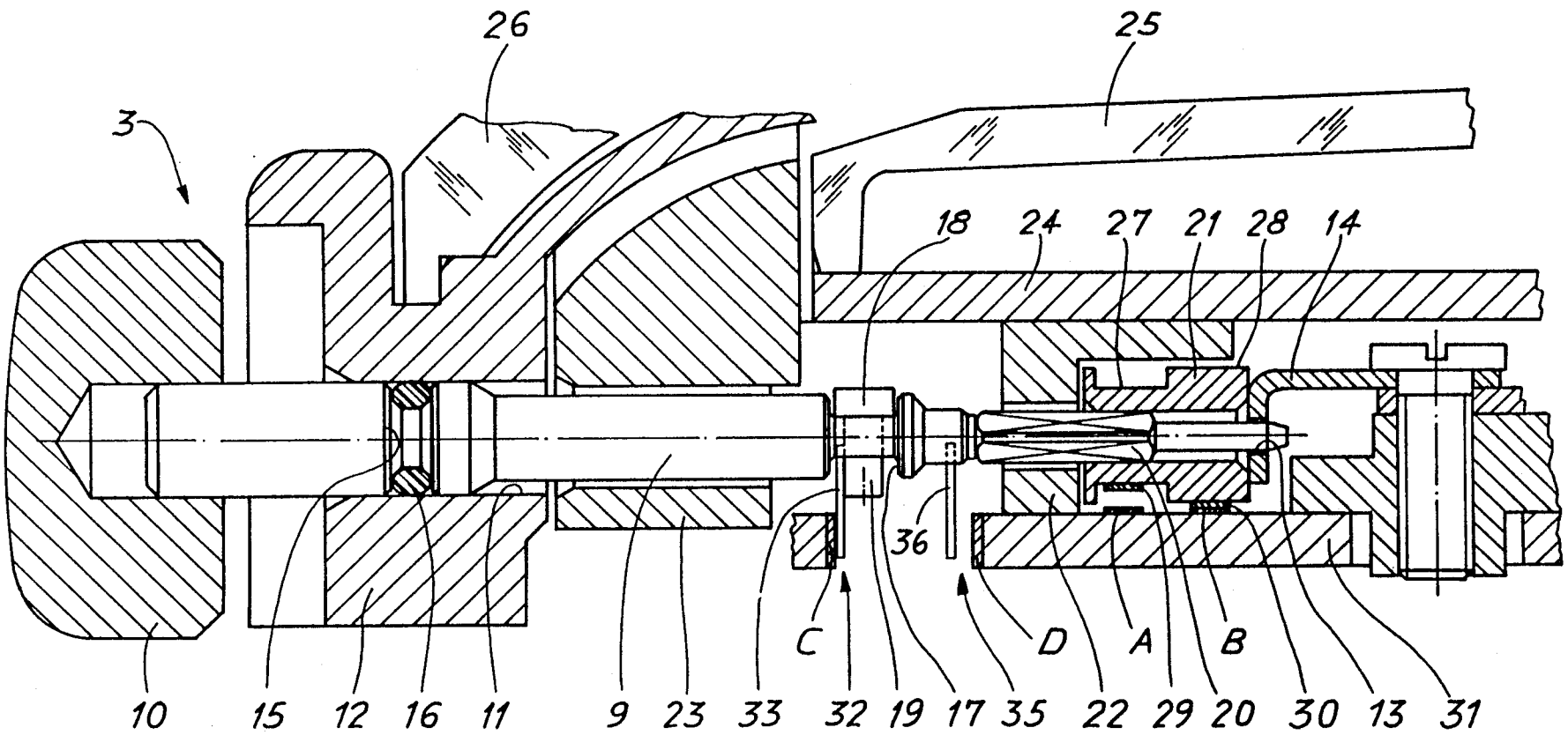
FIG. 1 shows the mechanism of the stem-crown in a first drawn-out stable position of the stem, such arrangement enabling, in accordance with the invention, to control the timepiece including the combination of a timekeeper and a pager.
Figure 2:
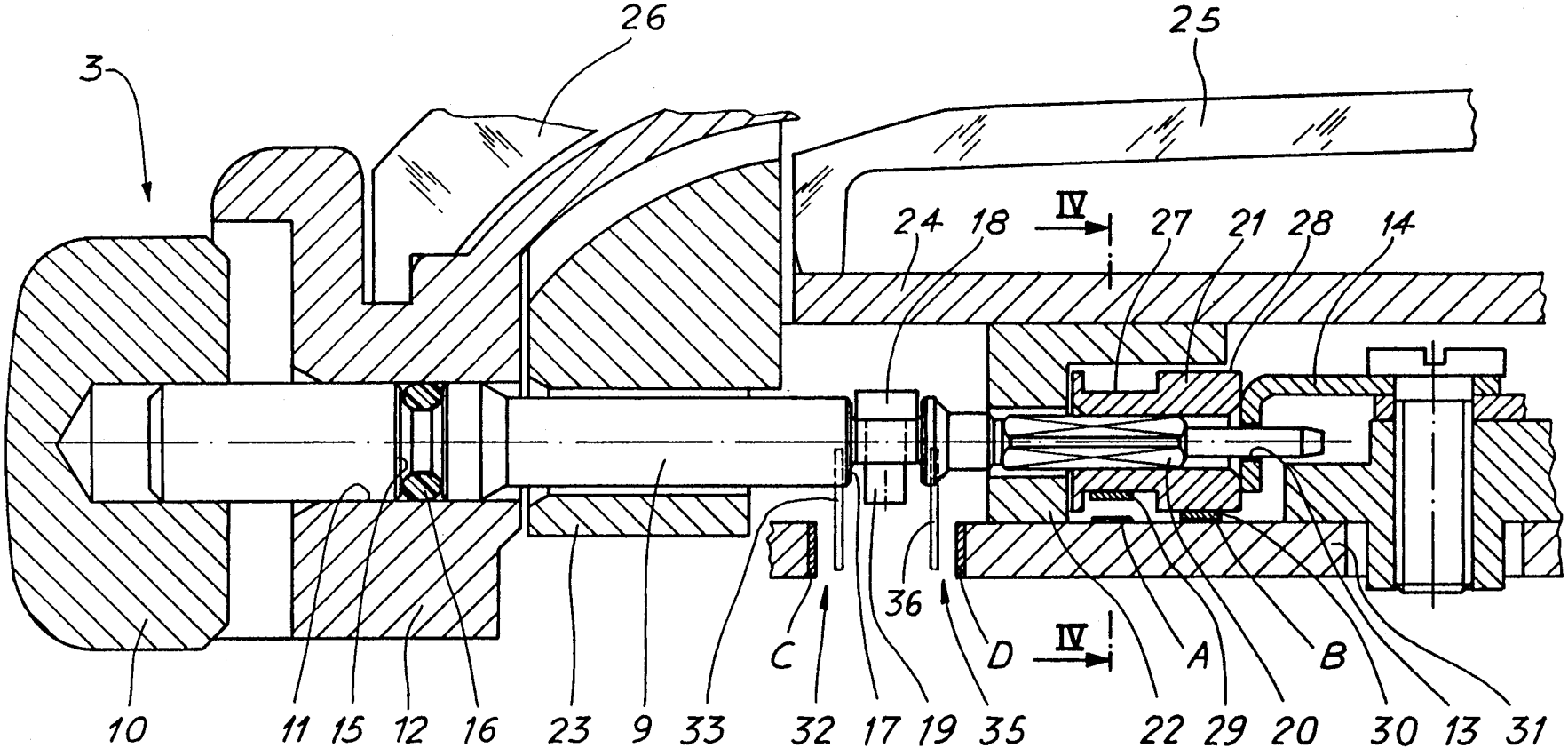
FIG. 2 shows the same mechanism in a second stable neutral position of the stem.
Figure 3:
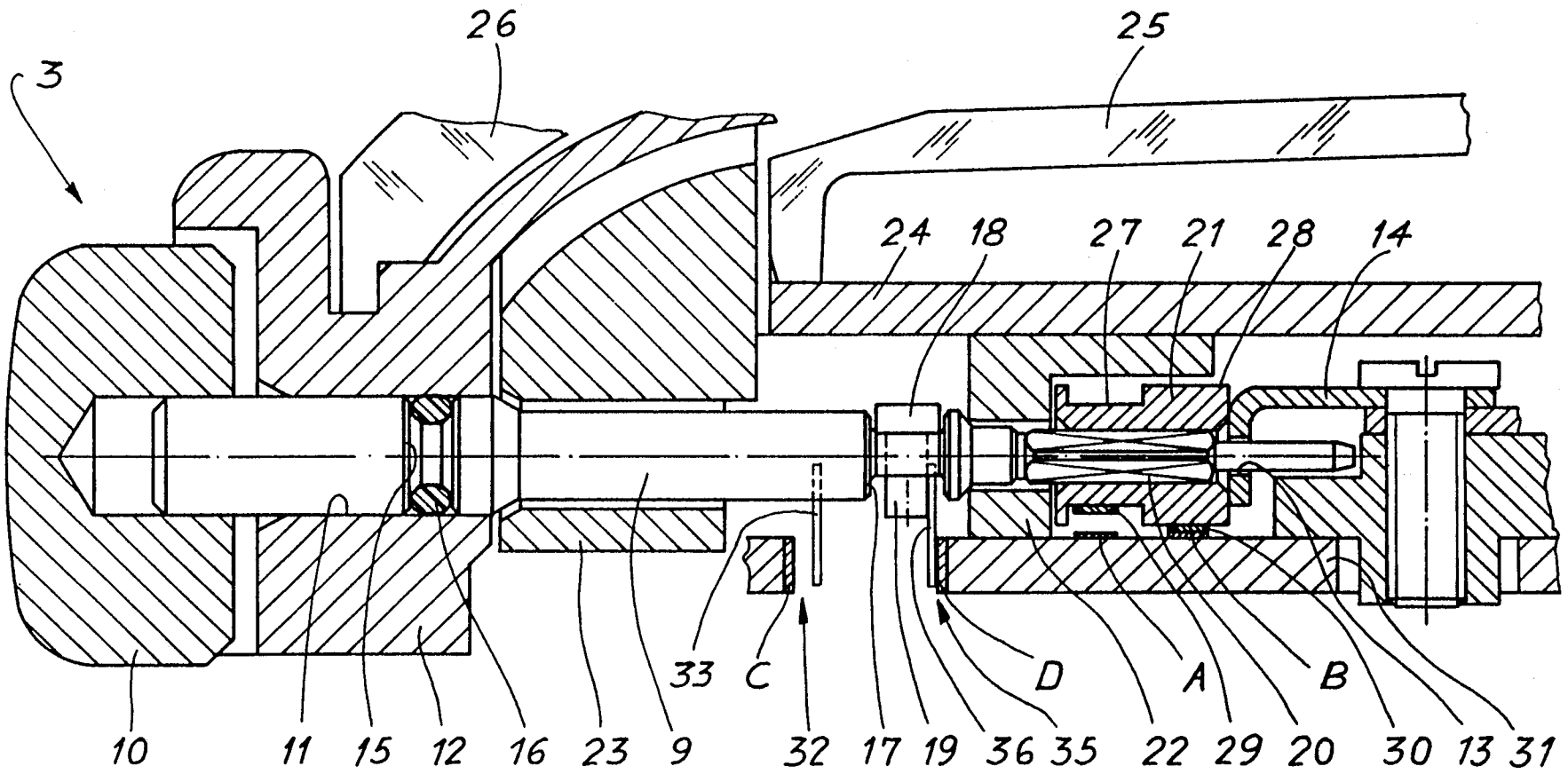
FIG. 3 shows the same mechanism in a third unstable pushed-in position of the stem.

The stem-crown 3 of FIGS. 1 to 3 includes a stem 9 fitted into a crown 10 at its end on which may be exerted either a rotational movement or a pressure. Stem 9 slides in an opening 11 formed in the caseband 12 of the case and in a hole 13 formed in an elbowed element 14. The stem includes a groove 15 in which is placed a packing 16. The stem further includes another groove 17 in which is adjusted a rocking lever 18 fixed to a slug 19. Finally, the stem comprises a squared-off portion 20 adapted to slide in a sliding pinion 21 axially retained in place by the elbowed element 14 and by another fixed elbowed element 22. There will be further recognized on FIGS. 1 to 3 elements described in the patent document EP-A-0 460 526 cited hereinabove, that is to say, the base plate 23, the dial 24, the first crystal 25 and the second crystal 26.

Figure 5:
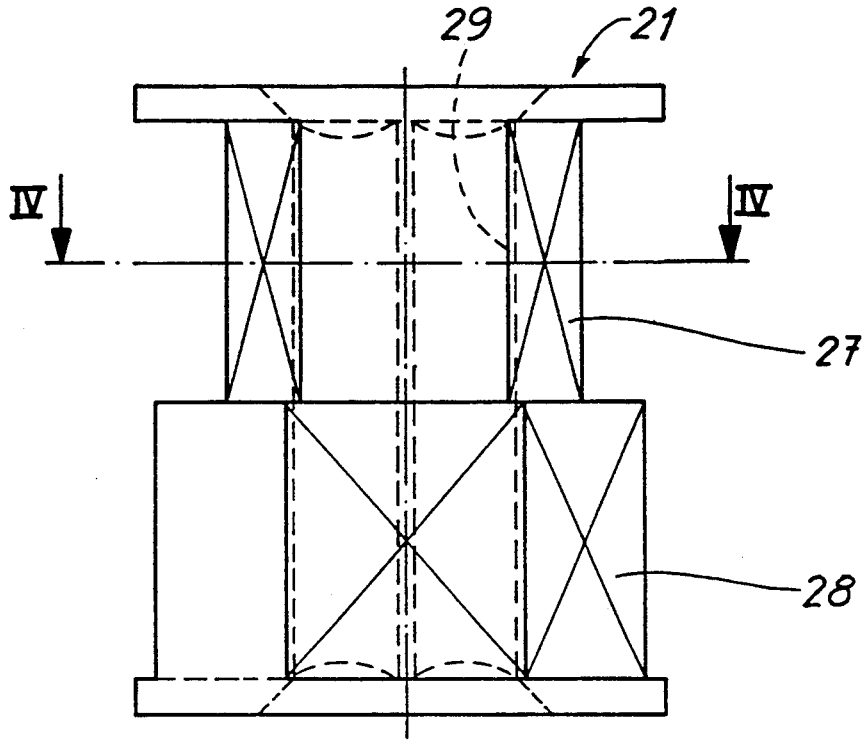
FIG. 5 is a view of the sliding pinion according to arrow V of FIG. 4.
Figure 4:
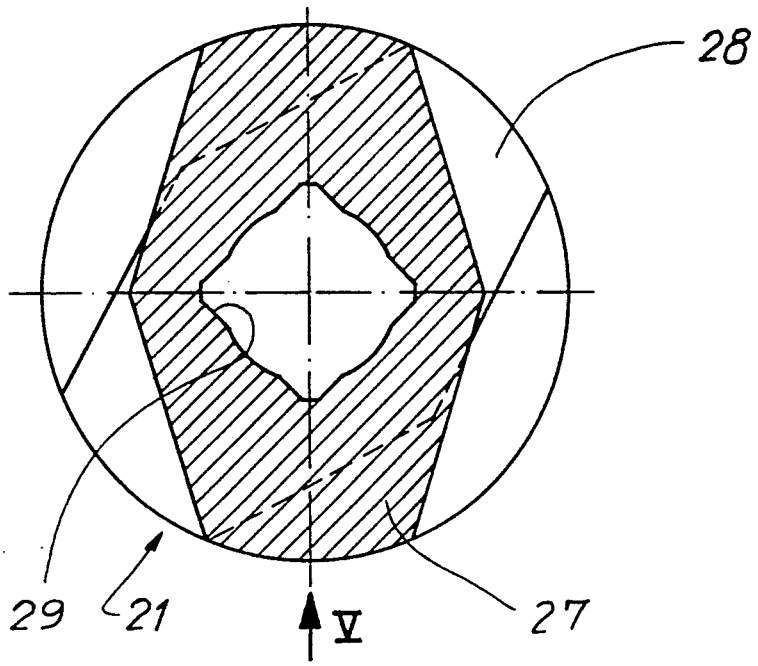
FIG. 4 is a cross-section along line IV—IV of FIG. 2 of the sliding pinion cooperating with the stem.

The sliding pinion 21 is shown in detail on FIGS. 4 and 5. As is seen on FIG. 5, it includes two stages 27 and 28 and a hole 29 intended to receive the squared-off portion 20 of stem 9. Each of the stages is provided with an oblong section as is readily seen on FIG. 4 on the hatched portion of stage 27. The stages 27 and 28 are angularly separated relative to one another by about 45°. As is seen on FIG. 2 and on FIG. 6, which is a plan view from below FIG. 2, conductive elastic blades 29 and 30 bear respectively on stages 27 and 28 of the sliding pinion 21 in a manner such that when the sliding pinion is driven in rotation by the stem, such blades 29 and 30 come alternatively into contact with conductive tracks respectively designated as A and B, such tracks being engraved on a printed circuit 31. FIGS. 1 to 3 show that whatever be the axial position of the stem, the sliding pinion 21 remaining in place, there is always contact of blade 29 onto track A and blade 30 onto track B, such contact taking place alternatively as has already been mentioned.

FIGS. 1 to 3 and FIG. 6 further show that the stem mechanism includes two further switches. A first switch 32 is formed by a conductive blade 33 adapted to come into contact with a conductive track C formed on the printed circuit 31. A second switch 35 is formed by a conductive blade 36 adapted to come into contact with a conductive track D also formed on the printed circuit 31. When driven by the slug 19 blades 33 and 36 come into contact with tracks C and D respectively, the slug 19 being driven in turn by the rocking lever 18 cooperating with the groove 17 of stem 9 as is apparent on FIGS. 1 and 3.

FIG. 1 shows the first drawn-out stable position of the stem-crown. This is the time setting position of the timepiece for any embodiment thereof (according to FIG. 8 or according to FIG. 15). Here the first switch 32 is closed and if the crown 10 is turned, the first 29 and second 30 conductive blades are alternatively driven to come into contact with the first A and second B respective conductive tracks. A rotation of the crown at an angular velocity less than a predetermined velocity enables a step-by-step correction of the minutes indication, plus or minus in accordance with the rotation sense of the crown, while a rotation of the crown at an angular velocity greater than said predetermined velocity enables rapid correction of the hours indication, plus or minus, by integral time zones in accordance with the sense of rotation of the crown. The means employed for such corrections are described in detail in the patent document CH-A-643 427 (U.S. Pat. No. 4,398,831), such means being taken up in both embodiments of the present invention. It may be added that in this first stable position the correction of the time zone takes as reference the real time which runs from the actuation in the drawn out position of the crown, means being employed to cancel all step-by-step minutes corrections which could have preceded the correction of the time zone, as has been set forth in patent document EP-B-0 175 961 (U.S. Pat. No. 4,620,797).

FIG. 2 shows the second stable and neutral position of the stem-crown. This is the position for which messages received by the pager may be displayed one after the other when the crown is turned. In this position the first 32 and second 35 switches are open, while the rotation of the stem drives the first 29 and second 30 blades which enter alternatively into contact with respectively the first A and second B conductive tracks.

FIG. 3 shows the third unstable and pushed-in position of the stem-crown. This is the position for which the displayed message may be erased or protected when one presses on the crown. In this position the second switch 35 is closed.

If reference is once again made to FIG. 6, it will be noticed that blades 29, 30, 33 and 36 together comprise a single element having a common base 37. Such blades are cut out from a metallic sheet and folded up at right angles as far as concerns blades 33 and 36. The four blades thus are found to be connected to a common electrical potential, i.e. Vpp as will appear in the schematics of FIGS. 10 and 17.

Figure 6:
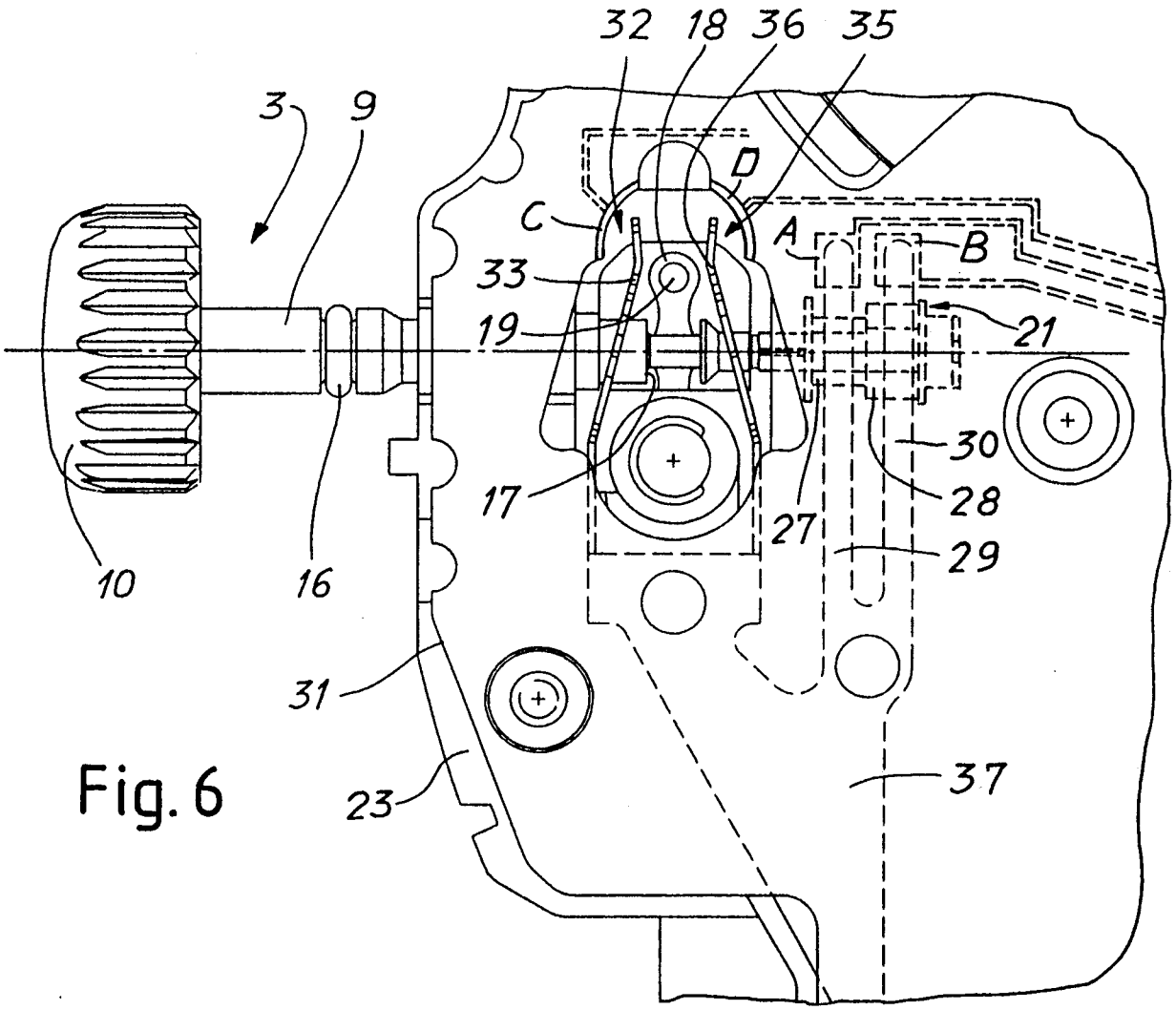
FIG. 6 is a plan view of the mechanism shown on FIG. 1.
Figure 7:
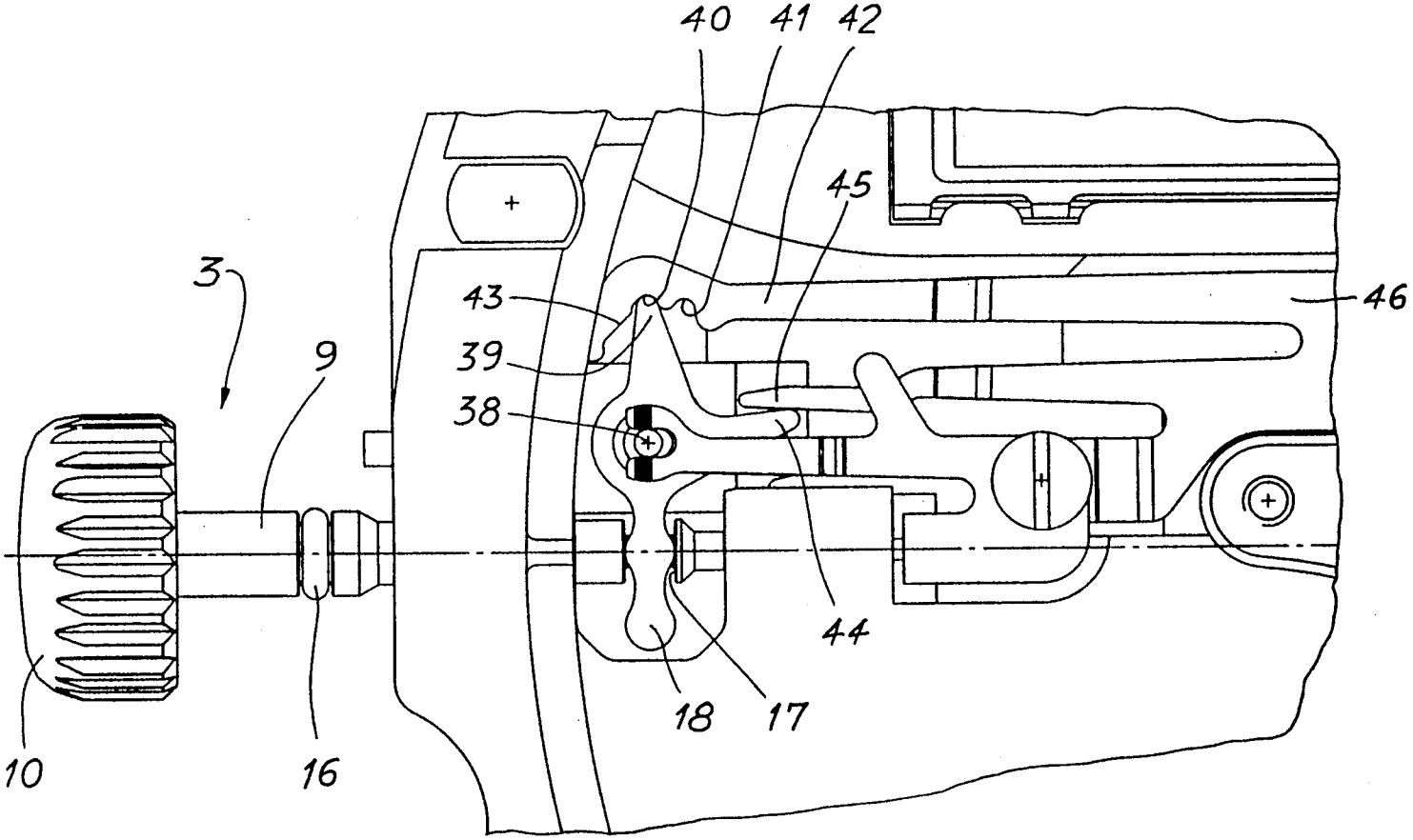
FIG. 7 is a view from below of FIG. 6, in which appears the latching system of the stem.

FIG. 7 which is a view from below of FIG. 6 shows that the rocking lever 18 driven by the groove 17 of stem 9 pivots around a retaining axis 38. The rocking lever is extended by a first nose 39 which cooperates with two notches 40 and 41 provided in a first elastic element 42. The stem of FIG. 7 is shown in the second neutral position in which nose 39 is latched in notch 40. In drawing on the stem in order to bring it into the first drawn-out position, nose 39 will be brought to latch in notch 41. Alternately, by pressing on stem 9 from the position which it occupies on FIG. 7, the nose 39 climbs a ramp 43 exhibited by the first elastic element 42 and which ramp tends to bring the stem back into the neutral position when the pressure thereon is interrupted. To increase further the return movement of the stem, the rocking lever 18 has been given a second nose 44 which cooperates with a second elastic element 45, both elastic elements being formed from a single piece 46.

The same stem-crown which has just been described will be employed in both embodiments of the pager watch according to the invention, which embodiments are now about to be described in detail. In sum, it has been seen that the operation of the stem is the same for both embodiments in question, as far as concerns a) the time setting function of the watch, b) the scanning function of messages one after the other and c) the erase or protection function of the message. For the remainder, the stem will present different functions according to whether it is employed in the one or the other of the embodiments in question.

1) First Embodiment

FIG. 8 is a plan view of the first embodiment of the pager watch according to the invention. In this embodiment the pager watch includes, in addition to the stem-crown described hereinabove in detail, two additional pushpieces 1 and 2. The first pushpiece 1, situated at 8 o'clock, enables turn-on and turn-off of the pager. The second pushpiece 2, situated at 10 o'clock, enables placing the pager in a standby state for which the received messages are at least stored in the memory without being signalled by the acoustic alarm 8.

Figure 9:
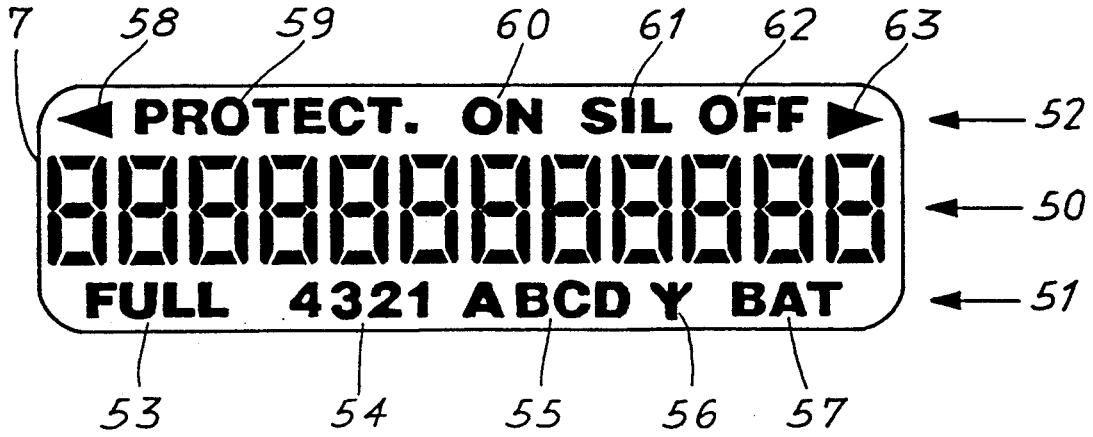
FIG. 9 is an enlarged representation of the display zone of the watch of FIG. 8 representing the various graphics capable of being displayed thereon.

FIG. 9 is an enlarged showing of the display cell referenced 7 on FIG. 8. This cell includes a zone 50 referred to as the message zone and two zones 51 and 52 referred to as indicator zones. In zone 50 appear the messages which may be formed of numbers and letters. Each character includes a set of segments, here seven segments at the most. The message may contain 12 characters at the most. In the indicator zone 51, there is found: at 53, the indication FULL which signals that the protected memory is full; at 54, numbers 4321 and at 55 letters ABCD, such numbers and letters being service indications setting forth respectively to which address and to which sub-address the received message has been sent; at 56, the sign Y indicating the quality of the radio reception; at 57, the indication BAT indicating that the battery of the pager must be replaced without delay. In the indicator zone 52, there is found: at 58, a sign indicating that there has been overflow of the message to the left of the cell; at 59, the indication PROTECT signalling that the displayed message has been protected; at 60, the indication ON signalling that the pager has turned on; at 61, the indication SIL signalling that the pager is in the standby state; at 62, the indication OFF signalling that the pager is turned off; at 63, a sign indicating that there has been overflow of the message to the right of the cell.

Figure 10:
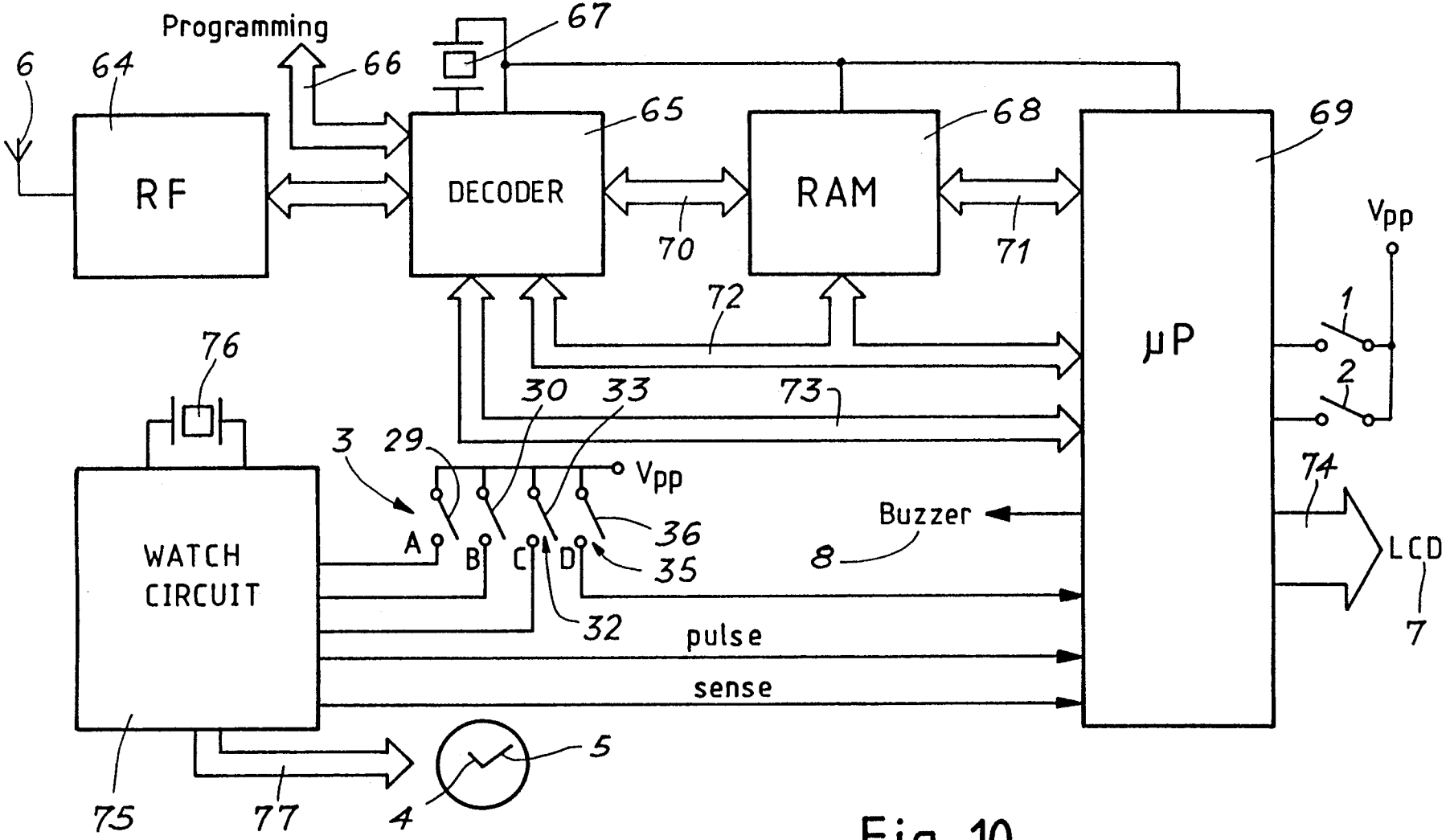
FIG. 10 is a schematic block diagram showing the electronic portion of the pager watch of FIG. 8.

FIG. 10 is a block schematic diagram showing the electronic portion of the pager watch shown on FIG. 8 The messages captured by the antenna 6 are received by a receiver circuit RF 64 (for example of the type UAA 2033 from the Philips company), then decoded by a decoder 65 (for example of the type PCF 5001 of the Philips company). Such decoder is programmable by its programming bus 66 in order to accept only messages intended for this special pager having its own radio identification code (RIC) and responding on occasion to the radio-electric call code Nr. 1 of the CCIR (based on the recommendation CCIR 5841, Dubrovnik, 1986). The decoder 65 has its own quartz clock 67. The pager further includes a memory RAM 68 of special construction and a micro-processor 69 (for instance of the type SMC 6234 of the Seiko company). The decoder, the memory and the micro-processor are coupled among themselves by bus lines 70 to 73 as shown on FIG. 10. The micro-processor 69 has an internal driver in a manner such that it directly feeds the display cell LCD 7 through bus 74. The same micro-processor includes an output terminal in order to feed an acoustic alarm or buzzer 8. Pushpieces 1 and 2, corresponding to those shown on FIG. 8, are connected to input terminals of the micro-processor. The pager watch further includes a watch circuit 75, (for example of the type H 5026 of the company EM Microelectronic-Marin SA) including in a known manner a watch quartz 76, a frequency divider and a driver driving through line 77 a stepping motor having two rotation senses, the axis of the rotor of such motor driving a wheel train and hours and minutes hands 4 and 5. To the watch circuit are connected the conductive tracks A, B and C to which correspond respectively the conductive blades 29, 30 and 33 of the stem-crown mechanism illustrated on FIGS. 1, 2, 3 and 6. To the micro-processor is connected the conductive track D to which corresponds the conductive blade 36 of the same mechanism. The micro-processor 69 and the watch circuit 75 are coupled together by a line "pulse" which bears a signal representing rotation of crown 3 and by a line "sense" which bears a signal representing the rotation sense of said crown. Here the angular velocity of rotation of the crown is said to be greater than a predetermined velocity (rapid rotation) if at least three pulses are present on the line "pulse" during a period of 200 ms. In the same manner, an angular velocity of the crown is said to be less than said predetermined velocity (slow rotation) if fewer than three pulses are present on the line "pulse" during the same period of 200 ms.

With the help of FIGS. 11 to 14, there will now be described the manner of making use of the pager in acting on the two pushpieces 1 and 2 and on crown 3. The symbols employed on the figures in question with their meaning are as follows:

>>1: Prolonged pressure on pushpiece 1 (ON/-OFF)

>>2: Prolonged pressure on pushpiece 2 (ON/SIL)

<<3: Prolonged pressure on crown 3

<3: Short duration pressure on crown 3

⋀: Rapid rotation of the crown in the positive sense

⋁: Rapid rotation of the crown in the negative sense

∧: Slow rotation of the crown in the positive sense

∨: Slow rotation of the crown in the negative sense

Y: Reception of a message

Figure 11:
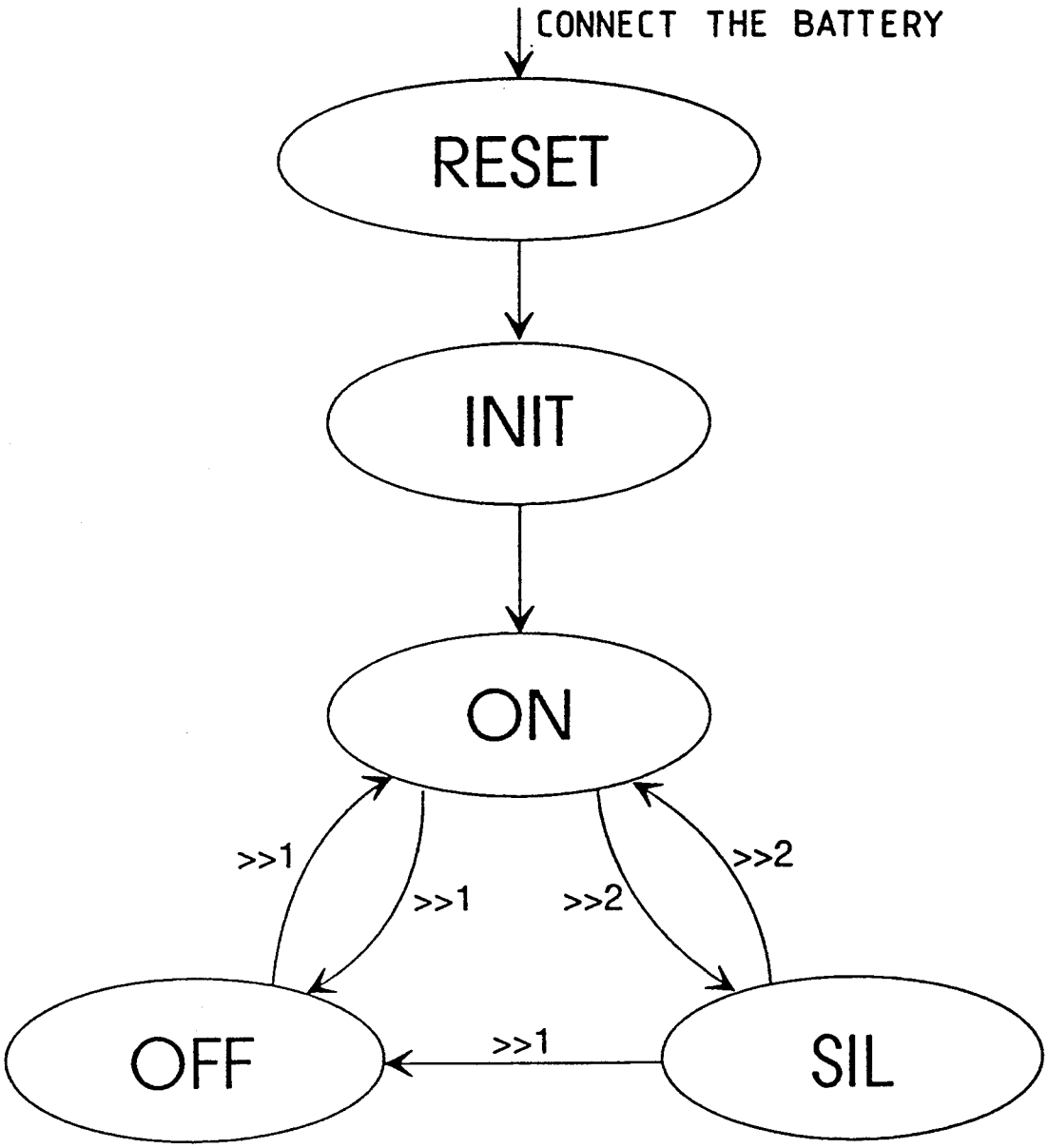
FIG. 11 is a diagram explaining the functions of push-pieces 1 and 2 with which the pager watch of FIG. 8 is equipped.

FIG. 11 explains the functions of pushpieces 1 and 2. When the pager is turned on, the indicator ON, referenced 60 on FIG. 9, is illuminated. To turn off the pager, a prolonged pressure is exerted on pushpiece 1 (>>1) and the indicator OFF, reference 62 on FIG. 9, is illuminated. In order to return to position ON there is exerted once again a prolonged pressure (>>1) on pushpiece 1, and the indication ON appears. Should one wish to place the pager in a standby state indicated on display 7 by the symbol SIL, abbreviation for the word SILence, initially one checks to see that the pager is in the ON stage, from which there is exerted a prolonged pressure (>>2) on the pushpiece 2. The indicator SIL is then illuminated and the pager is in the standby state, from which one may return to the ON state in pressing once again (>>2) on the pushpiece 2. FIG. 11 also shows that if the pager is placed in the SIL state, it may be turned off by pressing (>>1) on pushpiece 1. From the turned-off state (OFF) it will be necessary to go through the turned-on state (ON) in order to reach the standby state (SIL). The passage from one state to the other may be accompanied by an acoustic confirmation emitted by buzzer 8 (FIGS. 8 and 10), such passages to the ON, OFF and SIL states being possibly respectively accompanied by one, two and three acoustic bips.

FIG. 11 further shows that during changing of the battery energizing the pager, there is produced, when a new battery is connected, a first RESET phase for setting to zero of the pager electronics, followed by a second initialization phase INIT during which may appear on display 7 all the signs making up such display and this in particular in order to check correct operation.

Figure 12:
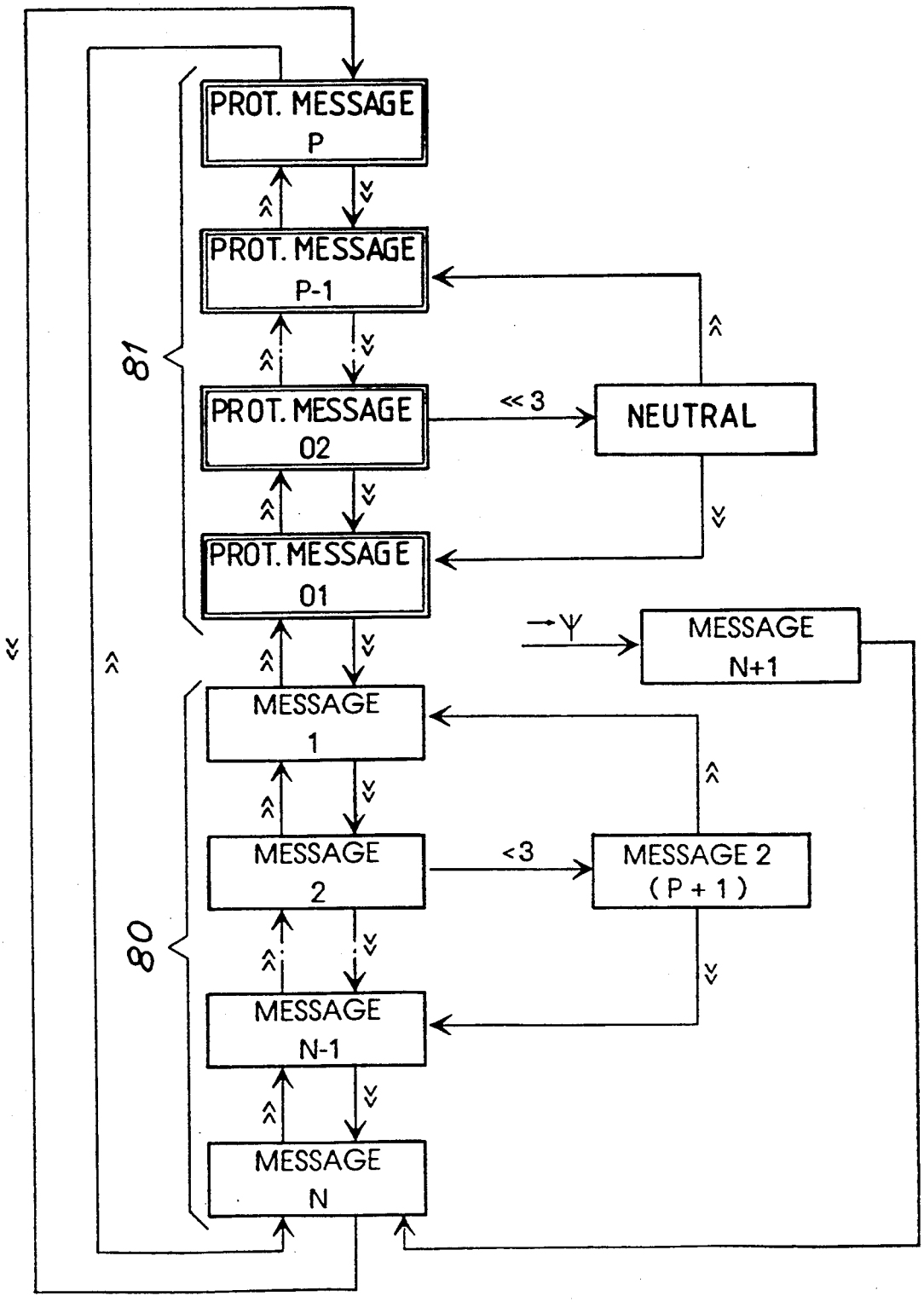
FIG. 12 is a diagram showing the arrangement of the memory of the pager watch of FIG. 8, such memory containing messages capable of being manipulated by the stem-crown 3.

FIG. 12 shows how the memory of the pager watch of FIG. 8 is arranged and what are the effects of rotation and pressure on the crown on the stored messages.

The RAM memory referenced 68 on FIG. 10 includes a first zone 80 adapted to store a limited number N of entering or unprotected messages. When this first zone is full, the inscription of the new message, namely the newly received message N+1 on FIG. 12, brings about the loss of the oldest message, namely message 1 on the figure. The RAM memory further includes a second zone 81 adapted to store a limited number P of protected messages when one actuates the crown in a manner which will be subsequently explained in order to cause passage of unprotected messages from zone 80 to protected message zone 81. In this case, if zone 81 is full, a message from zone 80 will no longer be able to be protected, and this fact will be indicated by the indicator FULL which will be illuminated as shown at 53 on FIG. 9. There results from this that the protection of a message prevents that the latter be automatically ejected from the memory in the case where said memory is full.

Let us suppose that message 1 is displayed on the cell. If the stem-crown 3 is rapidly rotated in the negative sense ⋁, that is to say in the counter-clockwise sense facing the crown, message 1 disappears to the benefit of message 2 which is displayed. If, on the contrary, starting from the display of message 1, the stem-crown is rapidly rotated in the positive sense ⋀, that is to say in the clockwise sense facing the crown, the message 1 disappears to the benefit of the protected message 01, the rapid rotation velocity being, as one may recall, a velocity of rotation greater than a predetermined angular velocity. FIG. 12 will cause understanding, in the same manner how, from the protected message P, one may pass to an unprotected message N and vice-versa.

Protection of a message is brought about in the following manner. It is supposed that message 2 is the message appearing on the display cell, and that the user of the pager wishes to protect it. For this, he brings the stem into its third unstable position by pressure on the crown 3 (<3) during a period less than a predetermined period, for example during a period less than one second. At this moment the indicator PROTECT referenced 59 on FIG. 9 is illuminated above the message, indicating to the user that message 2 is protected. From here a rapid rotation of the crown in the negative sense ⋁ or in the positive sense ⋀ will cause the respective appearance of the message N−1 or message 1, message 2 having been transferred from the first zone 80 of the memory to the second zone 81 in position P+1. In order to distinguish a protected message from an unprotected message, the protected message is assigned a special sign. For example, if the message is a telephone number, for instance 038-20-91-73, the protected message will be for example preceded by an order number, for instance 02, thereby indicating that it concerns the second protected message in zone 81, such message then showing itself under the form 02=038-20-91-73.

Erasing a message is brought about in the following manner. It is supposed that the protected message 02 is the message appearing on the display cell and that the user of the pager wishes to erase it. For this, he brings the stem into its third unstable position by pressure on the crown (<<3) during a period greater than a predetermined period, for example during a period greater than one second. At this instant, the displayed message disappears from the cell, which becomes neutral. From there a rapid rotation of the crown in the negative sense ⋁ or in the positive sense ⋀ will cause respective appearance of the message 01 or the message P−1. It is well understood that an unprotected message may also be acted on by the erasure operation, the essential for such operation being that of causing the message which one wishes to erase to appear on the display.

The arrival of a message (N+1 on FIG. 12) is accompanied by an acoustic signal made up from a series of bips emitted during about 10 seconds, unless the pager is placed in a standby state (SIL). Such signal may be interrupted by a short pressure exerted on any of the pushpieces 1, 2 or 3.

It has been seen that the functions of protection or erasure are brought about respectively by a short or long pressure exerted on the crown. In order to distinguish the short period from the long period, one may have the short period followed by one acoustic bip which indicates to the user that he must release the pressure and the long period by two acoustic bips, which signals that the erasure function has been carried out.

Figure 13:
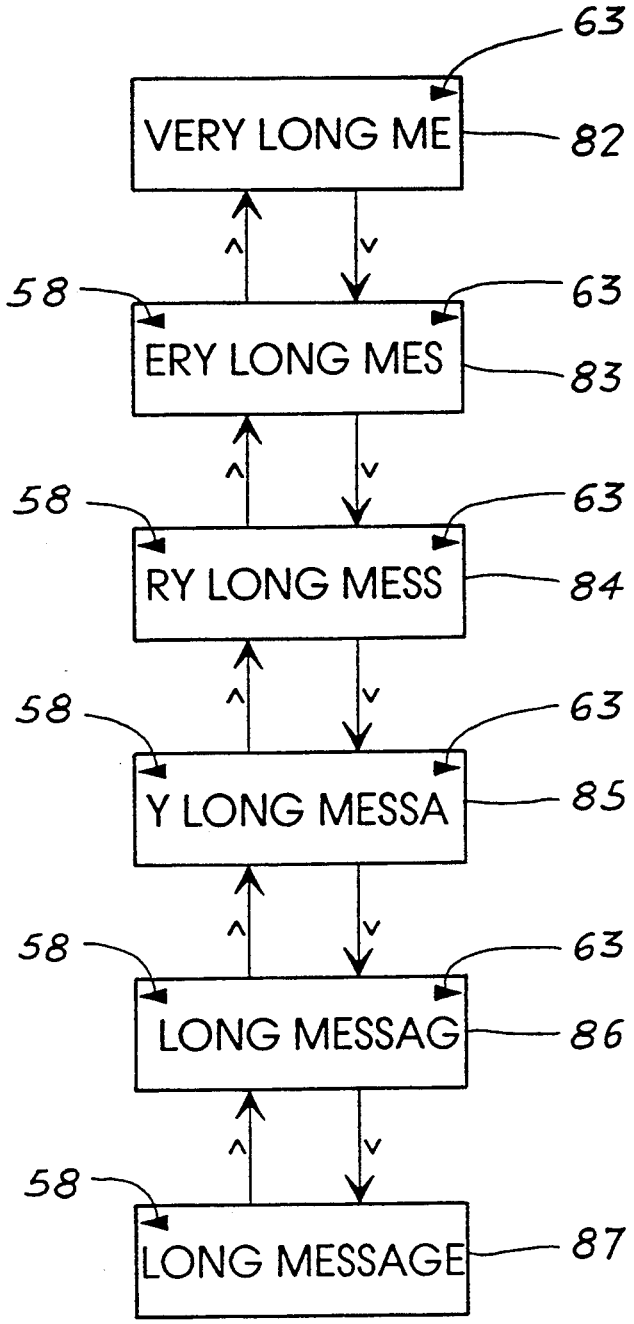
FIG. 13 is a diagram showing how to go about displacing a message exceeding the capacity of the display cell by means of the stem-crown 3 of the pager watch of FIG. 8.

The telephone number 038-20-91-73 taken as example hereinabove includes twelve characters (the dashes count as characters) and thus fills entirely the available space in the display cell taken as example on FIG. 9. It may however happen that the message is still longer and exceeds the capacity of the cell. If one supposes that such message includes the following words: VERY LONG MESSAGE, only the lines VERY LONG ME may be displayed as is seen on FIG. 13 which illustrates this example. The overflow of the message to the right is signalled by character 63 and to the left by character 58. Being then in the presence of the message referenced 82, one may cause shifting of the latter towards the left by providing the crown with slow rotation in the negative sense ∨, that is to say, in the counter-clockwise sense facing the crown, the slow speed of rotation, as will be recalled, being a speed of rotation less than a predetermined angular velocity. The displays referenced 83 to 87 are obtained by successive rotations of the crown in the negative sense, displays 83 to 86 showing an overflow to the right and to the left, which is signalled by the characters 63 and 58 respectively. The last display 87 shows the tail end of the message since the character 63 has disappeared and the character 58 alone subsists. FIG. 13 shows that from the display 87 one can go back up to display 82 in imparting a slow rotation to the crown in the positive sense ∧.

Figure 14:
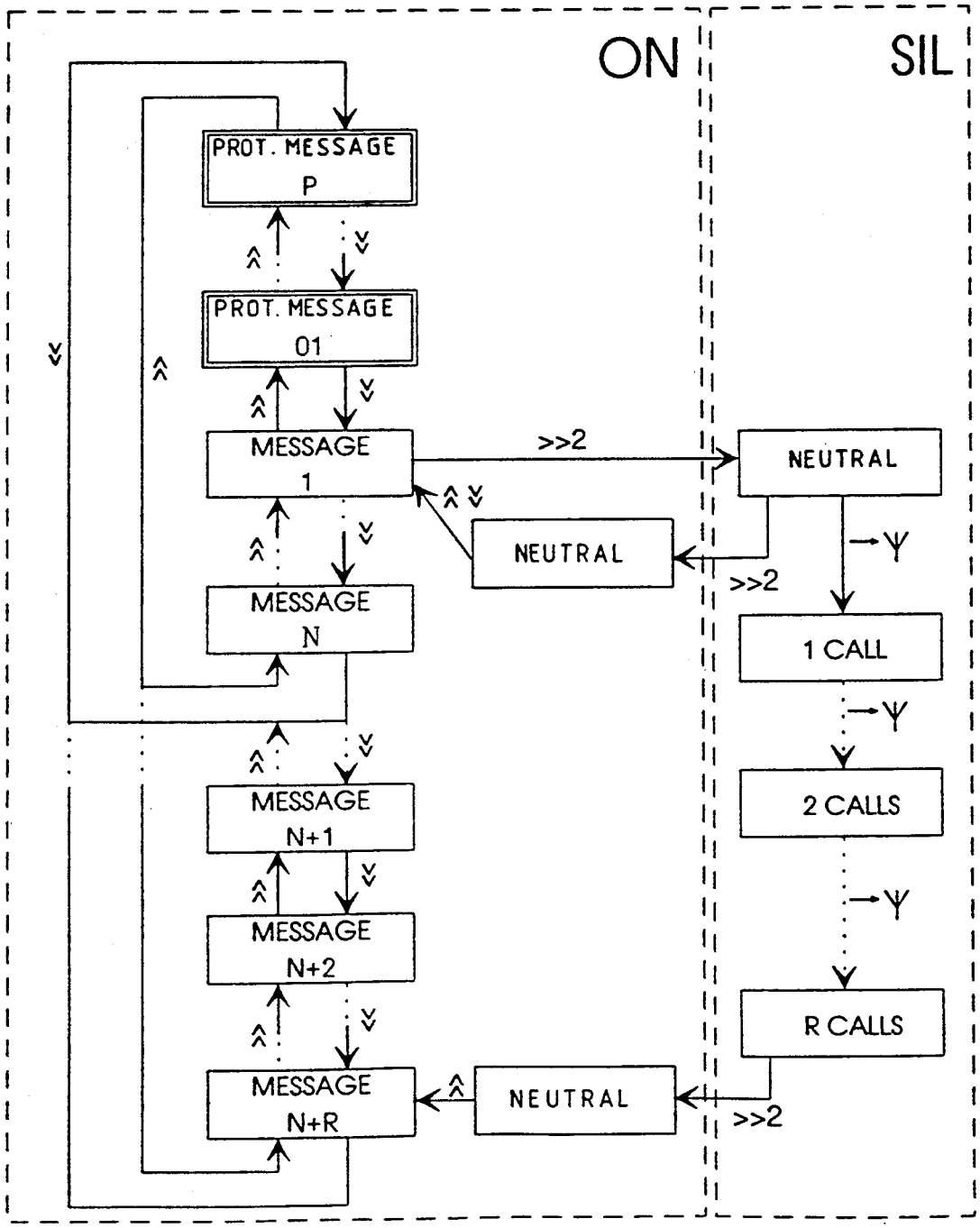
FIG. 14 is a diagram explaining the reception of messages when the pager watch is placed in a stand-by state.

FIG. 14 is a diagram explaining the reception of messages when the pager watch is in a standby state. In this figure, message 1 is displayed and the pager is in the ON state. A long pressure (>>2) on pushpiece 2 places the pager in the standby state (SIL). Message 1 disappears from the display (it is however not erased) which then shows no indication and is thus neutral, except for the sign SIL which appears. From this moment on messages received are at least inscribed in the memory without manifestation in an audible manner and indeed with no display appearing on the cell. In the example of FIG. 14, it has however been preferred to attribute to each message received in the SIL mode a rank number appearing on the display as 1 CALL, 2 CALLS, etc. which indicates thus the number of messages received in this mode. In order to render such messages readable (after R CALLS) it is again necessary to return to the ON mode by exerting a pressure on stem 2 (>>2). The display becomes neutral, then a rapid rotation of the crown in the positive sense ⩓ will bring about appearance in plain language of the last message received (N+R) and thus continuing.

2) Second Embodiment

FIG. 15 is a plan view of the second embodiment of the pager watch in accordance with the invention. In comparison with the first embodiment, the second embodiment includes only a single stem-crown 3 excluding any other pushpiece. Here the ON-OFF functions and ON-SIL described hereinabove are fulfilled by the stem-crown 3.

Figure 16:
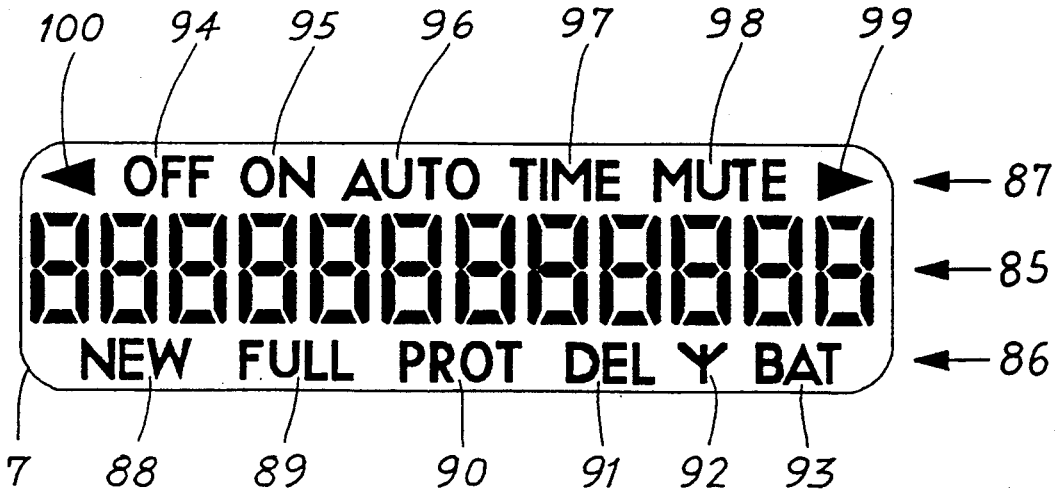
FIG. 16 is an enlarged representation of the display zone of the watch of FIG. 15 showing the various graphics adapted to be displayed thereon.

FIG. 16 is an enlarged representation of the display cell referenced 7 on FIG. 15. This cell includes a zone 85 referred to as message zone and two zones 86 and 87 referred to as indicator zones. In zone 85 appear messages which may be made up of numbers and of letters. Each character includes a set of segments, here seven segments at the maximum. In the display taken as example, the message may contain twelve characters at the maximum. In the indicator zone 86, one finds: at 88, the indication NEW which signals a new message and remains displayed as long as the latter has not been acknowledged by a short pressure on the crown; at 89, the indication FULL which signals that the memory is full; at 90, the indication PROT signalling the protection function of the message; at 91, the indication DEL signalling the erasure function; at 92, the character Y indicating that the radio cover is good, thus that reception of a message is possible; at 93, the indication BAT indicating that the pager battery must be changed. In the indicator zone 87, one finds: at 100, a character indicating that there has been overflow of the message to the left of the cell; at 94, the indication OFF signalling that the pager is turned off; at 95, the indication ON signalling that the pager is turned on; at 96, the indication AUTO signalling that the pager is turned on and turned off automatically; at 97, the indication TIME enabling setting of the internal clock of the pager; at 98, the indication MUTE signalling that the pager is in a standby state; at 89, a character indicating that there has been overflow of the message to the left of the display cell.

Figure 17:
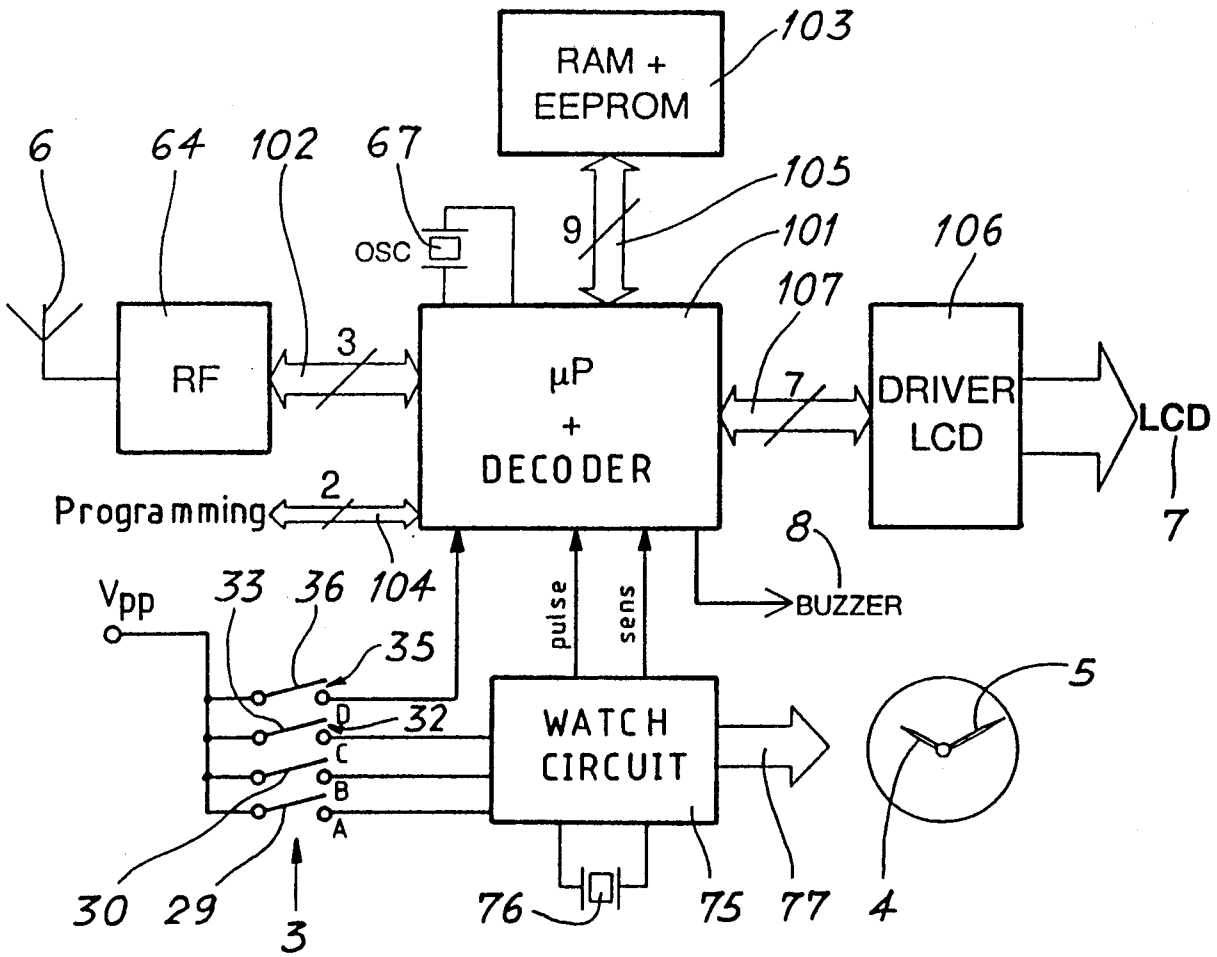
FIG. 17 is a schematic block diagram showing the electronic portion of the pager watch of FIG. 15.

FIG. 17 is a block schematic drawing showing the electronic portion of the pager watch illustrated on FIG. 15. Messages captured by antenna 6 are received by an RF circuit 64 (for example of the type UAA 2033 of the Philips Company) which is coupled to a micro-processor-decoder 101 by a bus 102 having three wires. The micro-processor-decoder 101 associates an ordinary micro-processor with a decoder of a type similar to that described referring to reference 65 on the schematic of FIG. 10. The decoder is associated with an external EEPROM memory 103 which may be programmed by the two wire bus 104 referred to as programming. As has already been mentioned with reference to the first embodiment, the decoder is programmed in order to accept only messages intended for this particular pager having its own radio identification code (RIC). The micro-processor-decoder 101 has its own quartz clock 67. The micro-processor-decoder 101 is coupled by a bus 105 with nine conductors 105 to the EEPROM memory already cited, such memory being associated with another memory RAM. The messages which are to appear on the liquid crystal display LCD 7 are controlled by a driver 106, itself coupled to the micro-processor 101 by a bus 107 with seven conductors. To micro-processor 101 there is coupled an acoustic alarm or buzzer 8. The schematic of FIG. 17 further includes a watch circuit 75 (for example of the type H 5026 of the EM Microelectronic-Marin SA Company) including a watch quartz 76, a frequency divider and a driver energizing through line 77 a stepping motor having two rotation senses, the axis of such motor driving a wheel train and hours and minutes hands 4 and 5. To the watch circuit 75 are connected the conductive tracks A, B and C to which correspond respectively the conductive blades 29, 30 and 33 of the stem-crown mechanism 3 illustrated on FIGS. 1, 2, 3 and 6. Here it will be recalled that when the crown is driven in rotation, tracks A and B are alternatively coupled to the potential Vpp and when the crown is in the first drawn-out position (time setting), track C is coupled permanently to the potential Vpp. To micro-processor 101 is connected the conductive track D to which corresponds the conductive blade 36 of the same mechanism and it will be recalled as well that when the crown is in the third unstable pushed-in position, track D is coupled to potential Vpp. The micro-processor 101 and the watch circuit 75 are coupled to one another by a line "pulse" which bears a signal relating to the fact that the crown 3 is driven in rotation and by a line "sense" which bears a signal relating to the sense of rotation of said crown.

The RAM memory 103 of FIG. 17 is of a manufacture more standard than that employed in the first embodiment of the invention. In this second embodiment, the messages contained in the RAM memory are stacked onto one another, the oldest at the bottom and the most recent at the top of the stack, and a zone without a message surmounts the most recent message, such zone presenting a neutral display when it is shown (see FIG. 19). The RAM memory being capable of containing only a limited number of messages, it is clear that if said memory is full, a new entering message is going to bring about the loss of the oldest message if this latter is not protected.

With the help of FIGS. 18 to 22, there will now be described the manner of making use of the pager in acting on a single crown 3, such manner being substantially different from that of the first embodiment since there no longer exist pushpieces ON-OFF and ON-SIL, the functions being now also fulfilled by the crown.

The symbols employed on FIGS. 18 and 19 with their significance are as follows:

<<: Long duration pressure on the crown

<: Short duration pressure on the crown

∧: Rotation of the crown in the positive sense

∨: Rotation of the crown in the negative sense

A pressure on the crown is long (<<) when its duration exceeds one second. Such pressure is short (<) when such duration is less than one second. The short or long pressures could also be acknowledged by an acoustic bip.

Generally, a rotation in the positive or negative sense of the crown enable the selection of a function, while a short pressure enables the validation of the chosen function and a long pressure enables the entry into a phase or special menu. All the manipulations of the pager are effected via the crown in its second neutral position, the first drawn-out position being employed only for time setting of the watch as has been mentioned hereinabove.

Figure 18:
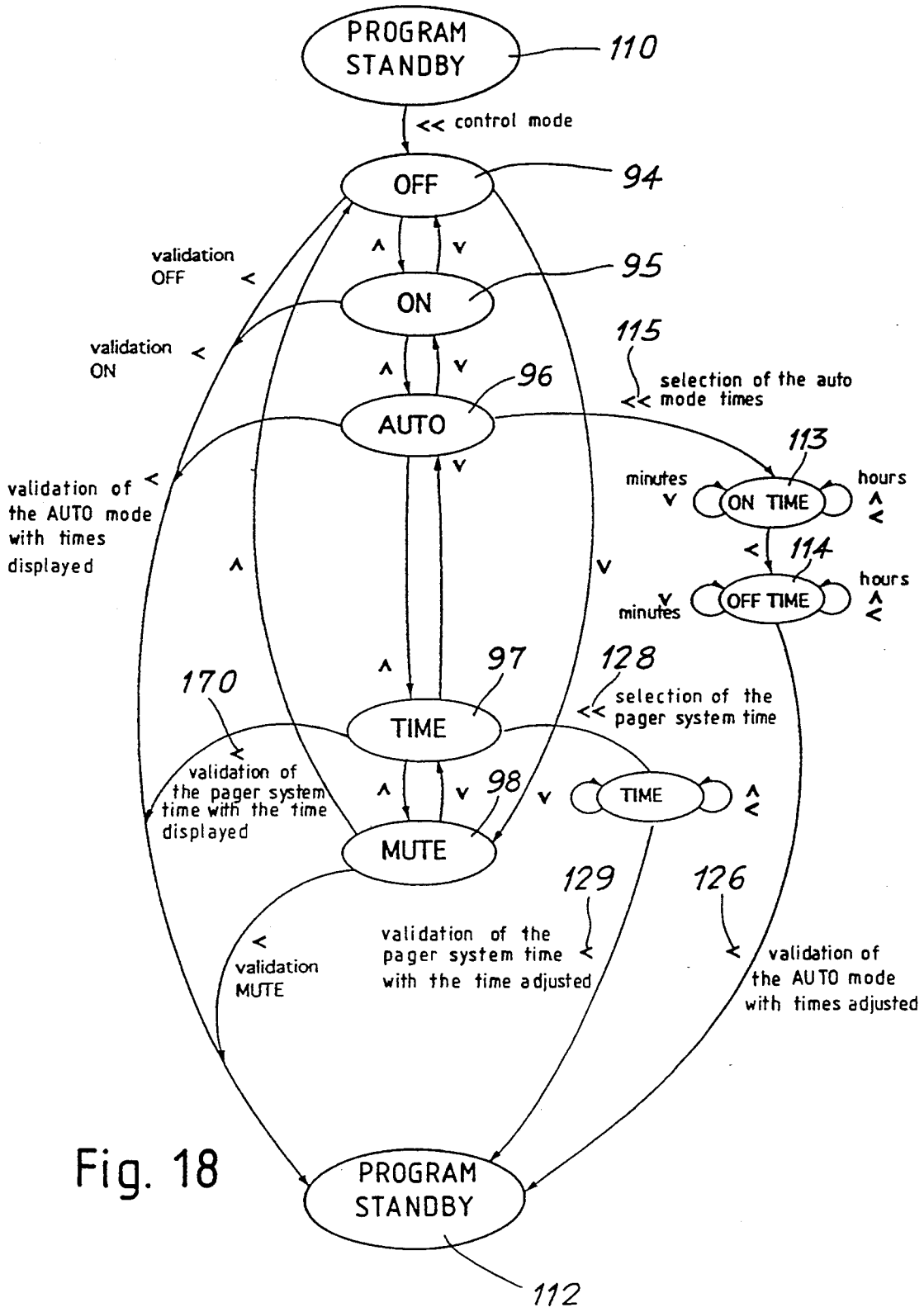
FIG. 18 is a diagram explaining the functions of the stem-crown of the watch of FIG. 15, such diagram illustrating the states of the pager in the control mode.

FIG. 18 is a diagram explaining the functions of the stem-crown of the watch illustrated on FIG. 15, such diagram illustrating the states of the pager in the control mode, such states being signalled by the indicators 94 (OFF) to 98 (MUTE) illustrated on FIG. 16.

In causing the crown to turn, one brings the pager into the program standby mode 110 for which the display is neutral. From here on, one may exert a long pressure << on the crown 3, which illuminates all the state indicators from OFF (94) to MUTE (98) with the OFF indication blinking. The state OFF may then be validated by exerting a short pressure < on the crown. The pager then returns to the program standby position 112 with the indicator OFF illuminated. If the ON state is wished for, one exerts a long pressure << on crown 3 which will illuminate all the state indicators from OFF (94) to MUTE (98) with the OFF indication blinking. One then turns the crown 3 in the positive sense ∧ until the ON indicator 95 blinks. The ON state may then be validated by exerting a short pressure < on the crown. The pager then returns to the program standby position 112 with the ON indication illuminated. As shown by FIG. 18, the other states AUTO 96, TIME 97 and MUTE 98 may be obtained in the same manner in observing that the selection of the state is obtained by rotation of the crown in the positive sense ∧ until the desired indicator blinks, and that the validation of the state which blinks is obtained by a short duration pressure on the crown. It is also observed on FIG. 18 that upon arriving at the state MUTE 98, one may return to the OFF state 94 in passing through all the intermediate states by turning the crown in the negative sense ∨.

FIG. 18 further shows that from the OFF state 94 one may directly attain the mute state 98 through rotation of the crown in the negative sense ∨. Inversely, from the MUTE state 98 one may return directly to the OFF state 94 by rotation of the crown in the positive sense ∧.

As indicated hereinabove, following the long duration pressure on the crown, all the indicators appear and one among them will be blinking. An alternative would be to cause blinking only of the selected indicator, the other indicators being extinguished.

If the OFF and ON states are self-understood, the MUTE, AUTO and TIME states merit explanations.

The MUTE state 98 has as its purpose to place the pager in a standby state, for which received messages are at least stored in the RAM memory without causing an acoustic signal to draw the attention of the wearer of the pager to the fact that a message has arrived. Normally, the arrival of a message is visible on the display cell and is accompanied by an acoustic signal. In the MUTE state, such acoustic signal is suppressed. The visible signal which is that of the appearance of the message on the display cell, could also be suppressed or be materialized by a serial number as has been explained hereinabove with reference to the first embodiment of the pager.

The AUTO state has for purpose to turn on and to turn off the pager automatically at times previously programmed by the pager user. By selecting the AUTO state 96 by rotation of the stem and in validating such state by a short duration pressure on the same crown, one returns to the program standby mode 112 with the time programmed by default, that is to say, those which are found in the special memory equipping the pager. The manner of adjusting the turn-on time, ON TIME 113, and the turn off time, OFF TIME 114, appearing on the diagram of FIG. 18, will now be explained in referring also to the program of manipulation shown on FIG. 22.

Figure 19:
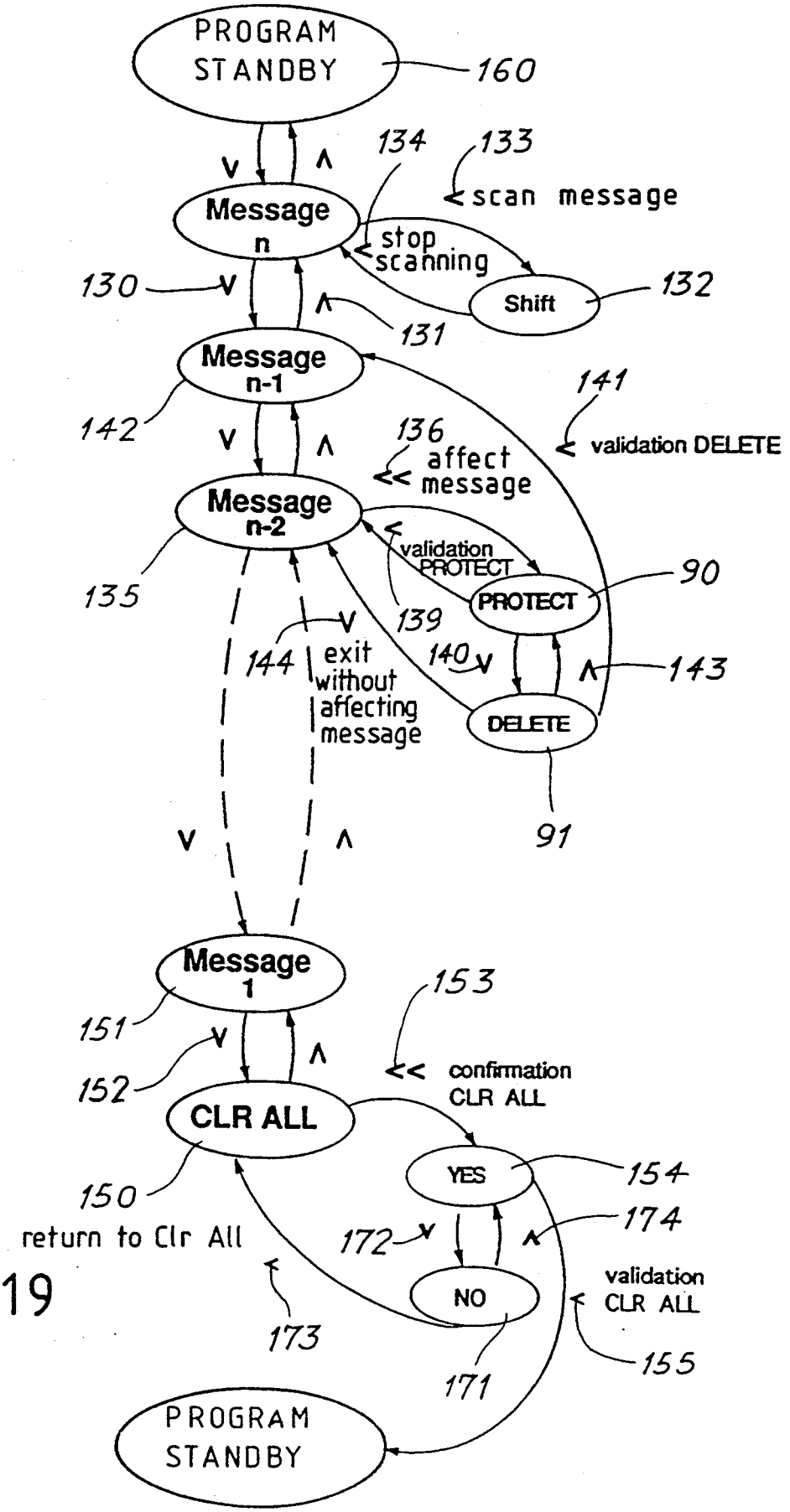
FIG. 19 is a diagram explaining the functions of the stem-crown of the watch of FIG. 15, such diagram illustrating the states of the pager in the message mode.
Figure 20:
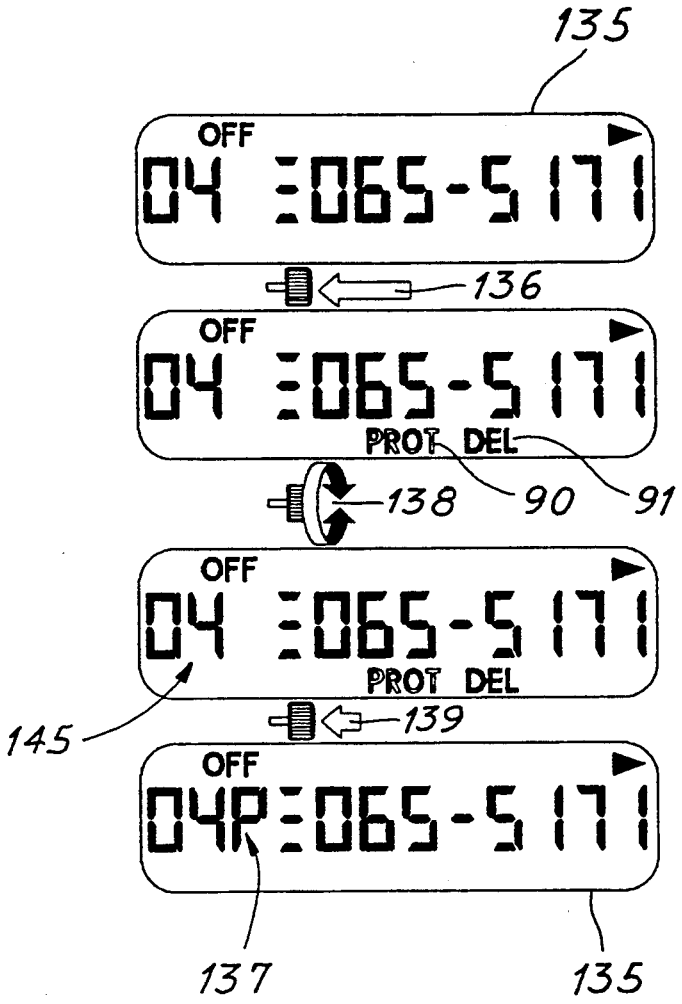
FIG. 20 shows the manipulation to be exerted on the stem-crown of the pager watch of FIG. 15 in order to protect a message contained in the memory.
Figure 21:
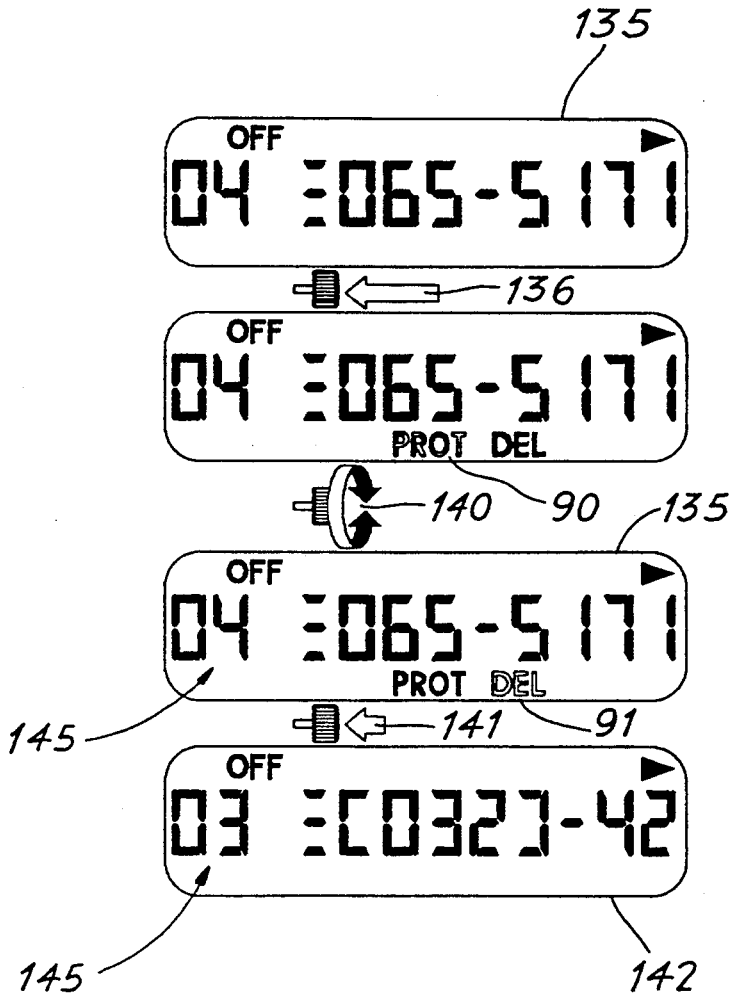
FIG. 21 shows the manipulation to be exerted on the stem-crown of the pager watch of FIG. 15 in order to erase a message contained in the memory.
Figure 22:
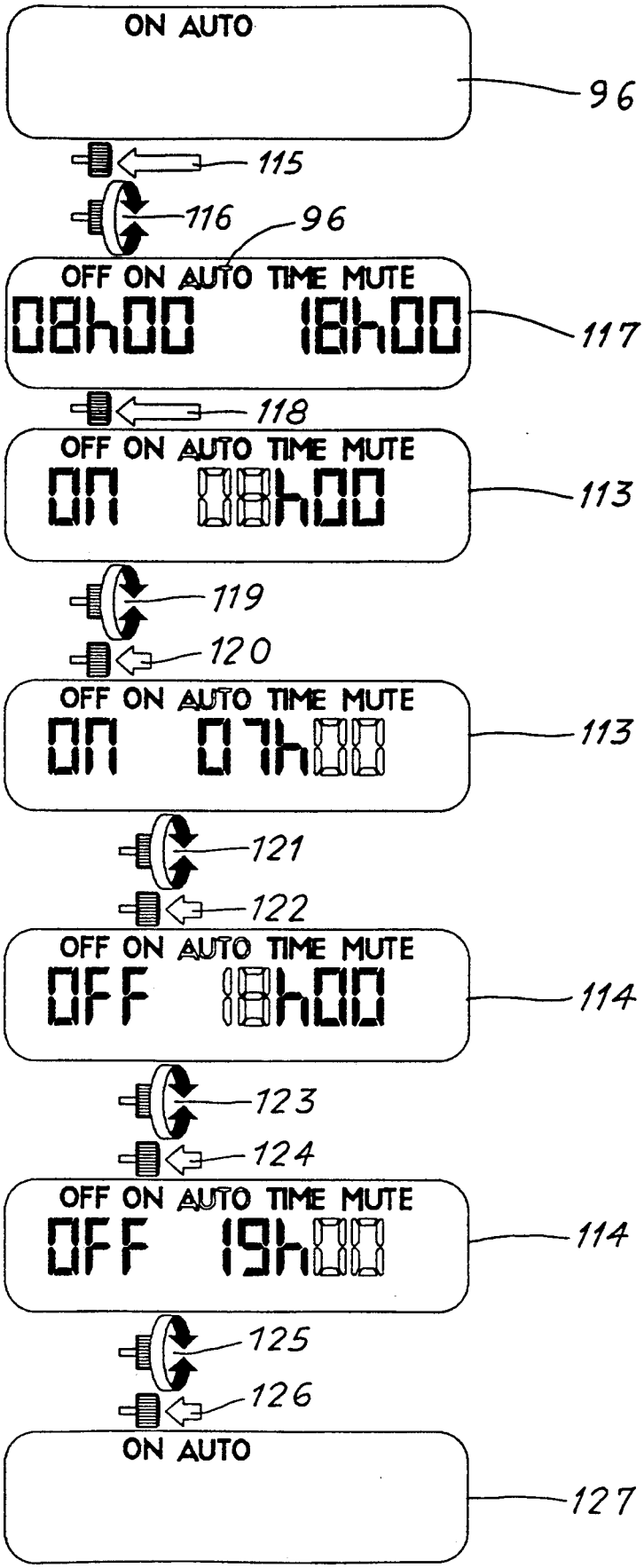
FIG. 22 shows the manipulation to be exerted on the stem-crown of the pager watch of FIG. 15 in order to program therein predetermined turn-on and turn-off times.

Here it may be indicated that on FIGS. 20, 21 and 22 a long duration pressure on the crown has been symbolized by an arrow with a long tail which is equivalent to the symbols << of FIGS. 18 and 19. In the same manner, a short duration pressure on the crown is symbolized on FIGS. 20, 21 and 22 by an arrow with a short tail, which is equivalent to the symbols < of FIGS. 18 and 19.

The crown is manipulated in order to cause appearance on the one hand of the neutral display and on the other hand the AUTO indicator 96 in the validated state in proceeding as indicated hereinabove. The indicator AUTO will be accompanied by the indicator ON if the time at which one proceeds to these adjustments is included in the turn-on period of the AUTO state. If not, the OFF indicator is eliminated. One then enters into the phase or control menu of times by a long duration pressure 115 on the crown. By exerting a rotation 116 on the crown, one may select the state AUTO 96 which blinks, the state of blinking being marked by the letters AUTO in clear on FIG. 22. When the mode AUTO has been selected, there then appears on display 117 the turn-on time (08h00) and the turn-off time (18h00). Once again a long duration pressure 118 is exerted on the crown the result of which is to enter the adjustment menu of the AUTO times. The turn-on time (08h00) appears alone accompanied by the indication ON. The hours (08) blink. The hours are programmed by rotation 119 of the crown. The new hours programming (07) is validated by a pressure 120 on the crown. Validation of the hours brings about the blinking of the minutes (00) of the hour of turn-on. One then programs the minutes by rotation 121 of the crown. One validates the new programming of the minutes (00) by pressure 122 on the crown. The validation of the minutes brings about the appearance of the turn-off hour (18h00) with the OFF indication and the blinking of the hours (18) of turn-off. The hours are programmed by rotation 123 of the crown. Validation of the new programming of the hours 19 is by a pressure 124 on the crown which brings about blinking of the minutes (00) of the turn-off hour. One programs the minutes by rotation 125 of the crown. One validates the new programming of the minutes (00) by a pressure 126 on the crown, this validation bringing about the return to the neutral display 127 with the inscription AUTO and the inscription ON if the time of day is included in the turn-on time.

The state TIME 97 shown on FIG. 18 has as purpose to set the pager to the time of day for correct operation of the AUTO function. This time setting is brought about in the following manner: the pager is placed into the neutral display with the AUTO state illuminated. One then enters into a phase or control menu by a long duration pressure on the crown. By turning the crown one selects the menu TIME 97 which brings about display of the time of day. A further long duration pressure (<<128) on the crown causes the hours of the time of day to blink, such hours then being adjustable by rotation of the crown, then validated by a short duration pressure on said crown. Validation of the hours brings about blinking of the minutes which may then be adjusted by rotation of the crown then validated by a short duration pressure on said crown, such validation <129 bringing about the return to the neutral display.

In the case where, starting from the state TIME 97, one exerts a short duration pressure <170 on the crown in place of exerting a long duration pressure <<128, one returns to the standby position 112 in having validated the time which is already memorized in the pager.

It will be noted that the state AUTO and TIME are accessory functions which are not indispensable to the operation of the pager. In a simplified version thereof, they could be no longer present. It will be further mentioned that there is foreseen an automatic return into the standby mode from any one of the selected modes if no manipulation has been effected during thirty seconds.

FIG. 19 is a diagram explaining the functions of the stem-crown of the watch of FIG. 15, such diagram illustrating the states of the pager in the message mode.

In order to see the messages contained in the memory one after the other, one brings the crown to the second stable neutral position, then one rotates it. A rotation of the crown in the negative sense ∨ 130 causes the displayed message (for example message n), to disappear from the cell, an older message (message n−1) being substituted for the message which has disappeared. Inversely, a rotation of the crown in the positive sense ∧ 131 brings about disappearance from the cell of the displayed message (for example n−1), with a more recent message (message n) being substituted for the message which has disappeared.

In the case where a message, message n for example, exceeds the capacity of the display cell, it is possible to have it be scanned (shift 132) character by character by exerting a short duration pressure <133 on the crown, in order to cause appearance of the hidden characters.

In the version concerned herein, once all the hidden signs have been rendered apparent, the scanning automatically changes in sense. In order to stop the scanning, one exerts once again a short duration pressure <134 on the crown.

The protection of the message is brought about in the following manner. It is supposed that one wishes to protect message n−2 of FIG. 19, such message appearing under the reference 135 in FIG. 20. For that, one exerts a long duration pressure 136 on the crown, which permits entering a phase or menu for treatment of messages in which appear indicators PROT 90 and DEL 91. The protection option PROT 90 is then selected by default. One then selects the desired option by rotation 138 of the crown, which operation in fact is not necessary since the indicator PROT will already be blinking. One finally validates the protected state of the message by a short duration pressure <139 on the crown, a sign P 137 indicating such state. The indicators PROT and DEL will have disappeared.

The erasure, indicated by the term DELETE or DEL is brought about in the following manner: it is supposed that one wishes to erase message n−2 indicated on FIG. 19, such message being referenced 135 on FIG. 21. For this, one exerts a long duration pressure <<136 on the crown, which permits entering into a phase or message treatment menu in which the indicator PROT 90 blinks by default as mentioned in the preceding paragraph. One selects the option DEL 91 by rotation ∨ 140 of the crown in the negative sense. The indicator DEL 91 blinks. Finally, one validates the erasure state by a short duration pressure <141 on the crown, the message 135 disappearing then from the display cell on which now appears the more recent message n−1 referenced 142. FIG. 19 also shows that from the option DELETE in blinking form, one may either return to the PROTECT option by rotation ∧ 143 of the crown in the negative sense, or return to the message n−2 without its being affected by rotation ∨ 144 of the crown in the negative sense.

In this second embodiment and as shown by FIGS. 20 and 21, the messages are preceded by an order number 145 which is not the case in the first embodiment in which such number appeared only for the protected messages. Here, as has been seen, the protected message bears a P preceding the order number.

As is further visible on FIG. 19, the pager may include arrangements for erasing on demand all unprotected messages. To proceed to such general erasure, symbolized by 150 on FIG. 19 by CLR ALL, the crown is driven in rotation ∨ until the first (the oldest) received message 151 is obtained. From there the rotation ∧ 152 of the crown is continued thereby to obtain that the cell displays CLR ALL which mode is confirmed by exerting a long duration pressure <<153 on the crown. At this moment there will appear the blinking word YES referenced 154. If then a short duration pressure <155 is exerted on the crown, the function CLR ALL is effected and all unprotected messages are at once erased. It will be noted that during the operation which has just been described, messages could be arriving which have not yet been acknowledged. The procedure described hereinabove does not erase such type of messages. FIG. 19 further shows that from the function YES 154, one may cause the appearance of a substitute function NO 171 by rotating the stem in the negative sense ∨ 172. If function NO 171 is validated by a short duration pressure <173 on the crown, one returns to CLR ALL without a general erasure. It will be noted that from the display NO 171 one may return to YES 154 by rotating the stem in the positive sense ∧ 174.

3. General Remarks

The two embodiments described hereinabove are examples among others which could be additionally conceived. The essential of the invention resides in the fact that from a stem-crown 3 one can at the same time: correct the time of day of the timekeeper by turning the crown, display any of the messages located in the memory of the pager also by turning the crown, and protect or erase one of the messages contained in the pager.

What we claim is:

1. A timepiece including a timekeeper for displaying at least hours and minutes, a receiver for radio broadcast messages made up from characters, a memory for storing said messages, a cell for displaying at least said messages, an acoustic or mechanical transducer and a control arrangement including at least one stem fitted into a crown adapted to be manually actuated, the stem being adapted to be brought into at least three different axial positions, a first stable position in which the timekeeper may be set to the time of day by rotation of the crown, a second stable position in which the received messages can be at least displayed one after the other by rotation of the crown and a third unstable position in which the message displayed can be at least erased or protected by action exerted in the longitudinal direction of the stem.

2. A timepiece as set forth in claim 1 wherein the first stable position is a drawn-out position arranged to close a first switch and for which the rotation of the crown drives alternatively first and second conductive blades which come respectively into contact with first and second conductive tracks, wherein the second stable position is an intermediate position between the first and the third position, for which second position rotation of the crown drives said first and second blades in the same fashion so as to enter into contact respectively with said first and second tracks, and wherein the third unstable position is a pushed-in position arranged to close a second switch when pressure is exerted on the crown.

3. A timepiece as set forth in claim 1 wherein the control arrangement further includes a first pushpiece adapted to switch the receiver for radio broadcast messages on or off and a second pushpiece adapted to place said receiver in a standby state for which received messages are at least stored in the memory without being signalled by said transducer.

4. A timepiece as set forth in claim 3 in which the entering message is displayed in plain language on the display cell if the first pushpiece has been actuated to turn on the receiver, while an acoustic signal is sounded which is interrupted after a predetermined period, the entering message not being accompanied by an acoustic signal if the second pushpiece has been actuated to place the receiver in the standby state, said display cell causing appearance only of the number of messages received during said standby state.

5. A timepiece as set forth in claim 1 wherein the control arrangement includes a single stem only, fitted into a crown adapted to be manually actuated.

6. A timepiece as set forth in claim 3 wherein, with the stem brought into its first stable position, rotation of the crown at an angular velocity below a predetermined velocity enables a step-by-step correction of the minutes indication, plus or minus in accordance with the rotation sense of the crown, and rotation of the crown at an angular velocity greater than said predetermined velocity enables rapid correction of the hours indication by integral time zones, plus or minus in accordance with the rotation sense of the crown.

7. A timepiece as set forth in claim 3 wherein the memory comprises a first zone adapted to store a limited number of incoming or unprotected messages for which, when said first zone is full, write-in of a new message brings about the loss of the oldest message and a second zone adapted to store a limited number of confirmed or protected messages.

8. A timepiece as set forth in claim 7 wherein, with the stem brought into its second stable position, rotation of the crown at an angular velocity below a predetermined velocity brings about a scanning of the displayed message character by character in one or the other sense in accordance with the rotation sense of the crown if the message contents exceed the capacity of the display cell and rotation of the crown at an angular velocity greater than said predetermined velocity brings about the passage from one message to another in one or the other sense in accordance with the rotation sense of the crown if the memory contains several messages.

9. A timepiece as set forth in claim 7 wherein, with the stem brought into its third unstable position by pressure on the crown during a period less than a predetermined period, an unprotected message appearing on the display cell passes from the first zone of the memory to the second zone thereof and becomes a protected message to which is allocated a special character.

10. A timepiece as set forth in claim 7 wherein, with the stem brought into its third unstable position by pressure on the crown during a period greater than a predetermined period, the message appearing on the display cell, whether or not protected, is erased from the memory and from said display cell.

11. A timepiece as set forth in claim 5 wherein the messages contained in the memory are stacked upon one another, the oldest at the bottom and the most recent at the top of the stack, a messageless zone, forming a neutral display when shown, surmounting the most recent message and wherein the memory can store only a limited number of messages so that if the memory is full a newly arriving message brings about loss of the oldest message if such is unprotected.

12. A timepiece as set forth in claim 11 wherein, with the stem brought into its second stable position, rotation of its crown brings about the passage from one message to another in one sense or the other according to the rotation sense of the crown if the memory contains several messages and, with said stem brought into its third unstable position during a time period less than a predetermined period by pressure on its crown, the displayed message is scanned character by character in one sense then in the other and so continuing if the contents of the message exceed the capacity of the display cell, stopping of the scanning being brought about by a further pressure on said crown.

13. A timepiece as set forth in claim 11 wherein, in order to protect or erase a message appearing on the display cell, the stem is brought into its third unstable position during a time period greater than a predetermined period by pressure on its crown in order to enter a phase in which the function of protection or the erase function by rotation of the crown can be chosen, said chosen function appearing on the display and being then susceptible to validation for the message displayed by a further pressure on the crown during a time period less than said predetermined period.

14. A timepiece as set forth in claim 13, further including means arranged to erase on request all unprotected messages.

15. A timepiece as set forth in claim 11 wherein, starting from said neutral display, the timepiece may be turned on, turned off or placed in a standby state for which received messages are at least stored in the memory by bringing the stem into its third unstable position during a time period greater than a predetermined period by pressure on its crown, so as to enter a phase in which the turn-on, turn-off or standby function can be chosen by rotation of the crown, said chosen function appearing on the display and being then susceptible to validation by excercising a further pressure on the crown during a time period less than said predetermined period.

16. A timepiece as set forth in claim 15, further including means for turning it on and turning it off at times of day chosen by the user.

17. A timepiece as set forth in claim 5, further including means for turning it on and turning it off at times of day chosen by the user.

* * * * *